US007935389B2

(12) United States Patent
Takahashi et al.

(10) Patent No.: US 7,935,389 B2
(45) Date of Patent: May 3, 2011

(54) LIQUID SPRAYING APPARATUS AND METHOD

(75) Inventors: Takanori Takahashi, Kanagawa (JP); Kenji Okamoto, Kanagawa (JP); Soichi Kuwahara, Kanagawa (JP); Yuji Yakura, Kanagawa (JP); Shinichi Horii, Kanagawa (JP); Yoshiaki Haba, Kanagawa (JP); Hiromitsu Takeda, Kanagawa (JP)

(73) Assignee: Sony Corporation, Tokyo (JP)

( * ) Notice: Subject to any disclaimer, the term of this patent is extended or adjusted under 35 U.S.C. 154(b) by 718 days.

(21) Appl. No.: 10/541,258

(22) PCT Filed: Nov. 4, 2004

(86) PCT No.: PCT/JP2004/016334

§ 371 (c)(1), (2), (4) Date: Jun. 29, 2005

(87) PCT Pub. No.: WO2005/044566

PCT Pub. Date: May 19, 2005

(65) Prior Publication Data

US 2006/0246212 A1 Nov. 2, 2006

(30) Foreign Application Priority Data

Nov. 5, 2003 (JP) ..... 2003-376116
Nov. 5, 2003 (JP) ..... 2003-376117

(51) Int. Cl.
*B05C 11/10* (2006.01)

(52) U.S. Cl. ..... 427/427.2; 427/422; 118/666; 118/667; 118/682

(58) Field of Classification Search ..... 118/666, 118/667, 682, 313; 427/8, 427.2, 422; 347/9
See application file for complete search history.

(56) References Cited

U.S. PATENT DOCUMENTS 5,995,909 A * 11/1999 Bretmersky et al. ..... 702/50
(Continued)

FOREIGN PATENT DOCUMENTS

EP 1 078 771 2/2001
EP 1 211 073 6/2002

*Primary Examiner* — George R Koch, III
(74) *Attorney, Agent, or Firm* — Robert J. Depke; Rockey, Depke & Lyons, LLC

(57) ABSTRACT

A printer is provided which sprays ink from nozzles to print recording paper P. It includes a paper feed/delivery mechanism (72) to carrying the paper P to which the ink is to adhere, nozzles (52*a*) to spray the ink as droplets, an ink-spraying head (45) to spray the ink from the nozzles toward the paper P having been carried to a position opposite to the nozzles, an ink-spraying controller (123) to control the ink-spraying head (45) to spray the ink from the nozzles in predetermined timing, a temperature sensor (74) to detect the ambient temperature and/or humidity when spraying the ink from the nozzles, a speed discrimination unit (73) to judge whether the carrying speed of the paper P has been changed, a memory (128) having stored therein ink-spraying control data intended for controlling the spraying timing correspondingly to the type of the paper P, and a controller (129) to delay, when the carrying speed of the paper P has been increased in the process of printing, the timing of spraying ink in other color than black based on the temperature detected by the temperature sensor and ink-spraying control data for the type of the paper P, pre-stored in the memory, in relation to that which is before the carrying speed of the paper P is increased, thereby projecting the other ink than the black ink to a position to which the black ink is to be projected.

24 Claims, 23 Drawing Sheets

U.S. PATENT DOCUMENTS 6,467,883 B1 10/2002 Sakurai
2002/0079325 A1* 6/2002 Estelle ..... 222/1
2004/0231594 A1* 11/2004 Edwards et al. ..... 118/719

* cited by examiner

LIQUID SPRAYING APPARATUS AND METHOD

This application is a national stage entry of PCT/JP04/16334, filed on Nov. 4, 2004.

TECHNICAL FIELD

The present invention relates to a liquid spraying apparatus and method in which liquid under a pressure produced by a pressure-producing element is sprayed as droplets from nozzles onto recording paper.

This application claims the priority of the Japanese Patent Application No. 2003-376116 and No. 2003-376117 both filed on Nov. 5, 2003, the entireties of which are incorporated by reference herein.

BACKGROUND ART

As a typical one of the conventional liquid spraying apparatuses, an ink-jet printer is known in which ink is sprayed onto recording paper from tiny holes in a liquid-spraying head to form graphics and/or characters on the paper. The ink-jet printer is advantageous because of its low running cost, compact design and easy printing of an image in colors. In the inkjet printer, colored ink is supplied from an ink cartridge to an ink well or the like in a liquid-spraying head. An ink cartridge is provided for each ink color such as yellow, magenta, cyan or black, for example.

In the printer of this type, ink supplied to the ink well or the like is pressurized in the ink well by a pressure-producing element or the like provided in the ink well for spraying from tiny holes, namely, so-called nozzles, formed in the liquid-spraying head.

More particularly, the ink in the ink well is heated by a resistance heater provided in the ink well to produce bubbles in the ink on the resistance heater, and the ink is sprayed from the nozzles under a pressure produced by the bubbles inside the ink well for projection onto recording paper or the like to form graphics and/or characters on the paper.

The ink-jet printers include a serial printer in which, as the liquid-spraying head having an ink cartridge mounted thereon is moved across the width of recording paper, namely, in a direction nearly perpendicular to the moving direction of the paper, ink in a predetermined color is projected onto the paper, and also a line printer in which ink is sprayed in line from nozzles on a liquid-spraying head that have an ink-spraying range generally as wide as the width of recording paper. That is, the nozzles are arrayed across the paper width.

In the serial printer, the recording paper is kept from moving while the liquid-spraying head is moving in the direction nearly perpendicular to the moving direction of the paper, the liquid-spraying head sprays ink for projection onto the paper while moving, and these operations are repeated to form characters and/or graphics on the paper. On the other hand, in the line printer, the liquid-spraying head is immobilized or fixed to such an extent as to slightly be movable in order to prevent any uneven imprinting, and the liquid-spraying head sprays ink in line for projection onto the paper which is continuously being moved to form characters and/or graphics on the paper.

As above, different from the serial printer, the line printer has the liquid-spraying head which is not to be moved. So, it can print at a higher speed than the serial printer. Also, since in the line printer, the liquid-spraying head has not to be moved, each of the ink cartridges can be designed larger to contain an increased volume of ink. Since the liquid-spraying head is not moved, the line printer can be designed simple and the liquid-spraying head is provided integrally with each ink cartridge.

For quality printing by such an inkjet printer, it is important to print while keeping a constant distance between the nozzles and recording paper. On this account, it has been proposed as disclosed in the Japanese Patent Application Laid Open No. 90858 of 1996 to keep a constant distance between the nozzles and paper in the printer of this type by keeping the paper free from sagging with an appropriate load being given in a direction in the plane of the paper opposite to the nozzle side of the liquid-spraying head where there are provided nozzles.

The above will be explained more specifically below with reference to FIG. 1. As shown, a printer, generally indicated with a reference numeral 201, makes printing on recording paper P opposite to a nozzle side 202*a* of an ink-spraying head 202. For this printing, a feed roller 203 carries the paper P in the direction of arrow X in FIG. 1 to a printing position, and then a delivery roller 204 carries the printed paper P out of the printer 201. In the course of printing, the paper P is kept tight in the carrying direction by rotating the feed roller 203 at a speed of rotation about the roller axis while rotating the delivery roller 204 at a higher speed of rotation about the roller axis.

In the printer 201, when the trailing end of the recording paper P being carried in the direction of arrow X in FIG. 2 leaves a nip point of the feed roller 203, namely, a point of the paper P the feed roller 203 nips, a load the feed roller 203 slower in speed of rotation than the delivery roller 204 applies in a direction opposite to the carrying direction, that is, a load applied to the paper P in the direction of arrow Y in FIG. 2, will not act on the paper P any longer. Thus, since the load applied by the feed roller 203 to the paper P in the direction opposite to the carrying direction will not act on the paper P when the trailing end of the paper P leaves the nip point of the feed roller 203, the paper P will be carried only by the delivery roller 204 faster in speed of rotation than the feed roller 203 and hence at a higher speed in the process of printing.

Also, since the recording paper P will expand and contract in a direction in the plane thereof due to a temperature, humidity, etc. during printing, the carrying speed will be influenced by the temperature, humidity, etc. Further, since gripping or nipping of the paper P by the rollers 203 and 204 varies from one type of the paper P to another, the paper carrying speed will depend upon the paper type as well.

Thus, in the printer 201, when the trailing end of the recording paper P leaves the nip point of the feed roller 203, the carrying speed of the paper P will be increased under the influence of the printing temperature and humidity and the type of the paper P in the process of printing so that the ink will be projected to a position displaced in the carrying direction for an increment of the paper carrying speed, namely, so-called "color mis-registration" will occur, resulting in lower definition of printed characters or graphics. Also in the printer 201, since gripping or nipping of the paper P by the rollers 203 and 204 varies depending upon the type of the paper P, the paper P will be moved at a speed depending upon the type of the paper P.

More specifically, in the printer 201, a higher temperature and humidity will elongate a belt driven by a drive motor (not shown) that drives each of the rollers 203 and 204 and so the belt will have the pitch thereof increased. Thus, the belt tension is decreased, the feed pitch per tooth of pulleys of the rollers 203 and 204, on which the belt is wound, is decreased, the moving speed of the recording paper P is decreased and hence the color mis-registration will be smaller. More particularly, it is assumed here that carrying the paper P at a higher speed at normal temperature in the process of printing will cause a displacement between a position to which ink is projected from a nozzle located upstream in the moving direction of the paper P and a position to which ink is projected from a nozzle located downstream, resulting in color mis-registration of 300 μm, for example. On this assumption, when the temperature and humidity become higher, the paper P will be carried at a lower speed and hence the color mis-registration will be 250 μm, for example, which is smaller than that at normal temperature.

On the other hand, a low temperature and humidity will contract the belt whose pitch will thus be smaller. Thus, the belt tension is increased, the feed pitch per tooth of the pulleys of the rollers 203 and 204, on which the belt is wound, is increased, the recording paper P is carried at a higher speed and hence the color mis-registration will be larger. More particularly, it is also assumed here that carrying the paper P at a higher speed at normal temperature in the process of printing causes color mis-registration of 300 μm, for example. On this assumption, when the temperature and humidity become lower, the paper P will be carried at a higher speed and hence the color mis-registration will be 350 μm, for example, which is larger than that at normal temperature.

Also in the printer 201, the recording paper P of such a type as is gripped strongly by the rollers 203 and 204 will be carried at a higher speed in the process of printing, resulting in larger color mis-registration. On the other hand, the paper P of such a type as is gripped weakly by the rollers 203 and 204 will be carried at a lower speed in the processing of printing, resulting in smaller color mis-registration.

To solve the problem of such color mis-registration, it has been proposed as disclosed in the Japanese Patent Application Laid Open No. 186086 of 1993 to form the rollers 203 and 204 for carrying the recording paper P from a soft roller and hard roller, respectively, for the purpose of attenuating a shock caused when the paper P leaves the nip point.

However, use of the soft roller to attenuate the shock when the recording paper P leaves the nip point has not yet attained the solution of the problem of color mis-registration.

Also, as disclosed in the Japanese Patent Application Nos. 186086 of 1993 and 2002-225370, it has been proposed to provide a normally unused nozzle in addition to nozzles used for printing and correct color mis-registration with ink sprayed from the unused nozzle. The techniques proposed in these Published Unexamined Patent Applications are effectively usable in a serial liquid spraying apparatus but not in any line-head liquid spraying apparatus.

DISCLOSURE OF THE INVENTION

Accordingly, the present invention has an object to overcome the above-mentioned drawbacks of the related art by providing an improved and novel liquid spraying apparatus and method.

The present invention has another object to provide a liquid spraying apparatus and method, capable of spraying liquid without image-quality degradation due to color mis-registration.

The above object can be attained by providing a liquid spraying apparatus including according to the present invention:

a carrying means for carrying an object onto which liquid is to be projected in a predetermined direction;

a liquid spraying means having nozzles to spray and project the liquid as droplets onto the object having been carried to a position where the object faces the nozzles;

a liquid-spraying controlling means for controlling the liquid spraying means to spray the droplets from the nozzles in predetermined timing;

an environment detecting means for detecting an ambient temperature and/or humidity when the droplets are sprayed from the nozzles;

a carrying-speed discriminating means for judging whether the carrying speed of the object has been changed or not; and a storage means having stored therein liquid-spraying control data intended for controlling the liquid-spraying timing for each type of the object, when the carrying-speed discriminating means has determined that the object carrying speed has been changed, the liquid-spraying controlling means controlling the liquid-spraying means on the basis of the environment data detected by the environment detecting means and liquid-spraying control data stored in the storage means to spray the droplets from the nozzles in different timing from that which is before the carrying speed is changed.

Also the above object can be attained by providing a liquid spraying method to be employed in a liquid spraying apparatus including according to the present invention:

a carrying means for carrying an object onto which liquid is to be projected in a predetermined direction;

a liquid spraying means having nozzles to spray and project the liquid as droplets onto the object having been carried to a position where the object faces the nozzles;

a liquid-spraying controlling means for controlling the liquid spraying means to spray the droplets from the nozzles in predetermined timing;

an environment detecting means for detecting an ambient temperature and/or humidity when the droplets are sprayed from the nozzles;

a carrying-speed discriminating means for judging whether the carrying speed of the object has been changed or not; and a storage means having stored therein liquid-spraying control data intended for controlling the liquid-spraying timing for each type of the object, whereby when the carrying-speed discriminating means has determined that the object carrying speed has been changed, the droplets are sprayed from the nozzles in different timing from that which is before the carrying speed is changed on the basis of the environment data detected by the environment detecting means and liquid-spraying control data stored in the storage means.

According to the present invention, when the carrying-speed discriminating means has determined that the object carrying speed has been changed, the droplets are sprayed from the nozzles in different timing from that which is before the carrying speed is changed on the basis of environment data detected by the environment detecting means and liquid-spraying control data stored in the storage means, whereby the droplets are prevented from being projected to a position on the object, displaced in the object carrying direction due to the change in object carrying speed and correspondingly to the object type and ambient environment.

Also according to the present invention, when the object carrying speed is changed, the liquid-praying timing is adjusted based on the environment data detected by the environment detecting means and liquid-praying control data prestored in the storage means, and thus it is possible to prevent the droplets from being projected to a position on the object, displaced in the object carrying direction due to the change in object carrying speed caused by the temperature and humidity. Therefore, according to the present invention, printing can be done with a high quality without any projection of the droplets to any wrong position, that is, without any color mis-registration.

Further according to the present invention, since the liquid-praying timing can be controlled for each type of the object on the basis of the liquid-praying control data, it is possible to prevent the droplets from being projected to a position displaced in the object carrying direction correspondingly to the object type and print with a high quality without any color mis-registration on different types of objects.

Also the above object can be attained by providing a liquid spraying apparatus including according to the present invention:

a carrying means for carrying an object onto which liquid is to be projected in a predetermined direction;

a liquid spraying means having nozzles to spray and project the liquid as droplets onto the object having been carried to a position where the object faces the nozzles;

a liquid-praying controlling means for controlling the liquid spraying means to spray the droplets from the nozzles in predetermined timing;

an environment detecting means for detecting an ambient temperature and/or humidity when the droplets are sprayed from the nozzles;

a carrying-speed discriminating means for judging whether the carrying speed of the object has been changed or not;

a droplet-projected position detecting means for detecting a displacement of droplet-projected position, which arises when the droplets are projected in a predetermined pattern on the object being carried because the object carrying speed has been changed;

a data generating means for generating, for each type of the object onto which the droplets are projected in the predetermined pattern, liquid-spraying control data intended for controlling the liquid-spraying timing to correct the displacement of droplet-projected position detected by the liquid-protected position detecting means; and a storage means for storing the liquid-spraying control data generated by the data generating means for each object type, when the carrying-speed discriminating means has determined that the object carrying speed has been changed, the liquid-spraying controlling means controlling the liquid-spraying means on the basis of the environment data detected by the environment detecting means and liquid-spraying control data for each object type, stored in the storage means, to spray the droplets from the nozzles in different timing from that which is before the carrying speed is changed.

Also the above object can be attained by providing a liquid spraying method for a liquid praying apparatus including according to the present invention:

a carrying means for carrying an object onto which liquid is to be projected in a predetermined direction;

a liquid spraying means having nozzles to spray and project the liquid as droplets onto the object having been carried to a position where the object faces the nozzles;

a liquid-spraying controlling means for controlling the liquid spraying means to spray the droplets from the nozzles in predetermined timing;

an environment detecting means for detecting an ambient temperature and/or humidity when the droplets are sprayed from the nozzles;

a carrying-speed discriminating means for judging whether the carrying speed of the object has been changed or not;

a droplet-projected position detecting means for detecting a displacement of droplet-projected position, which arises when the droplets are projected in a predetermined pattern on the object being carried because the object carrying speed has been changed;

a data generating means for generating, for each type of the object on which the droplets are projected in the predetermined pattern, liquid-spraying control data intended for controlling the liquid-spraying timing to correct the displacement of droplet-projected position detected by the liquid-protected position detecting means; and a storage means for storing the liquid-spraying control data generated by the data generating means for each object type, whereby when the carrying-speed discriminating means has determined that the object carrying speed has been changed, the liquid-spraying controlling means controls the liquid-spraying means on the basis of the environment data detected by the environment detecting means and liquid-spraying control data for each object type, stored in the storage means, to spray the droplets from the nozzles in different timing from that which is before the carrying speed is changed.

According to the present invention, when the carrying-speed discriminating means has determined that the object carrying speed has been changed, the droplets are sprayed in different timing from that which is before the carrying speed is changed on the basis of the environment data detected by the environment detecting means and liquid-spraying control data generated by the data generating means for each type of the object from the result of displacement of droplet-projected position, which arises when the carrying speed has been changed and has been detected by the droplet-projected position detecting means, thereby preventing the droplets from being projected to a position on the object, displaced in the object carrying direction due to the change in object carrying speed caused by the object type and ambient environment.

Also according to the present invention, when the object carrying speed is changed, the liquid-spraying timing is adjusted based on the environment data detected by the environment detecting means and liquid-spraying control data pre-stored in the storage means to prevent the droplets from being projected to a wrong position on the object. So it is possible to prevent the droplets from being projected to a position on the object, displaced in the object carrying direction due to the object carrying speed change caused by the temperature and humidity Therefore, according to the present invention, printing can be done with a high quality without any projection of the droplets to any wrong position, that is, without any color mis-registration.

Further according to the present invention, since the liquid-spraying timing can be controlled based on the liquid-spraying control data for each object type, the droplets can be prevented from being projected to a wrong position in the carrying direction for each type of the object and thus printing can be done with a high quality without any displacement of the droplet-projected position, that is, without any color mis-registration of the droplets on different types of objects.

BRIEF DESCRIPTION OF THE DRAWINGS

FIGS. 9A and 9B are sectional views of the ink-spraying head, in which FIG. 9A shows bubbles being produced in a resistance heater and FIG. 9B shows ink sprayed from nozzles.

BEST MODE FOR CARRYING OUT THE INVENTION

The present invention will be described in detail below concerning the first embodiment of each of the liquid spraying apparatus and method according to the present invention with reference to the accompanying drawings.

Figure 1:
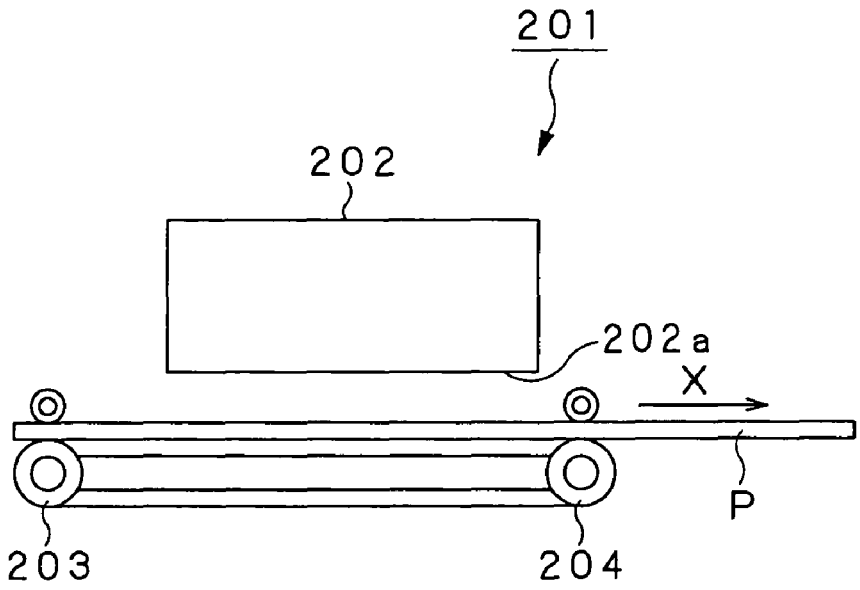
FIG. 1 is a schematic side elevation of a conventional printer.
Figure 2:
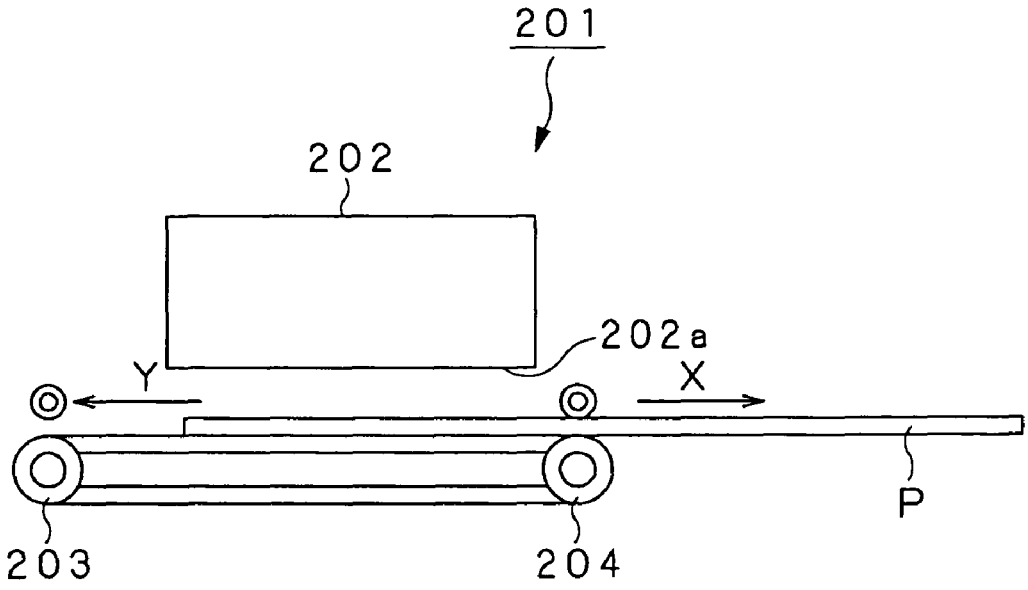
FIG. 2 is also a side elevation of the conventional printer in FIG. 1, showing the change in moving speed of the recording paper in the process of printing.
Figure 3:
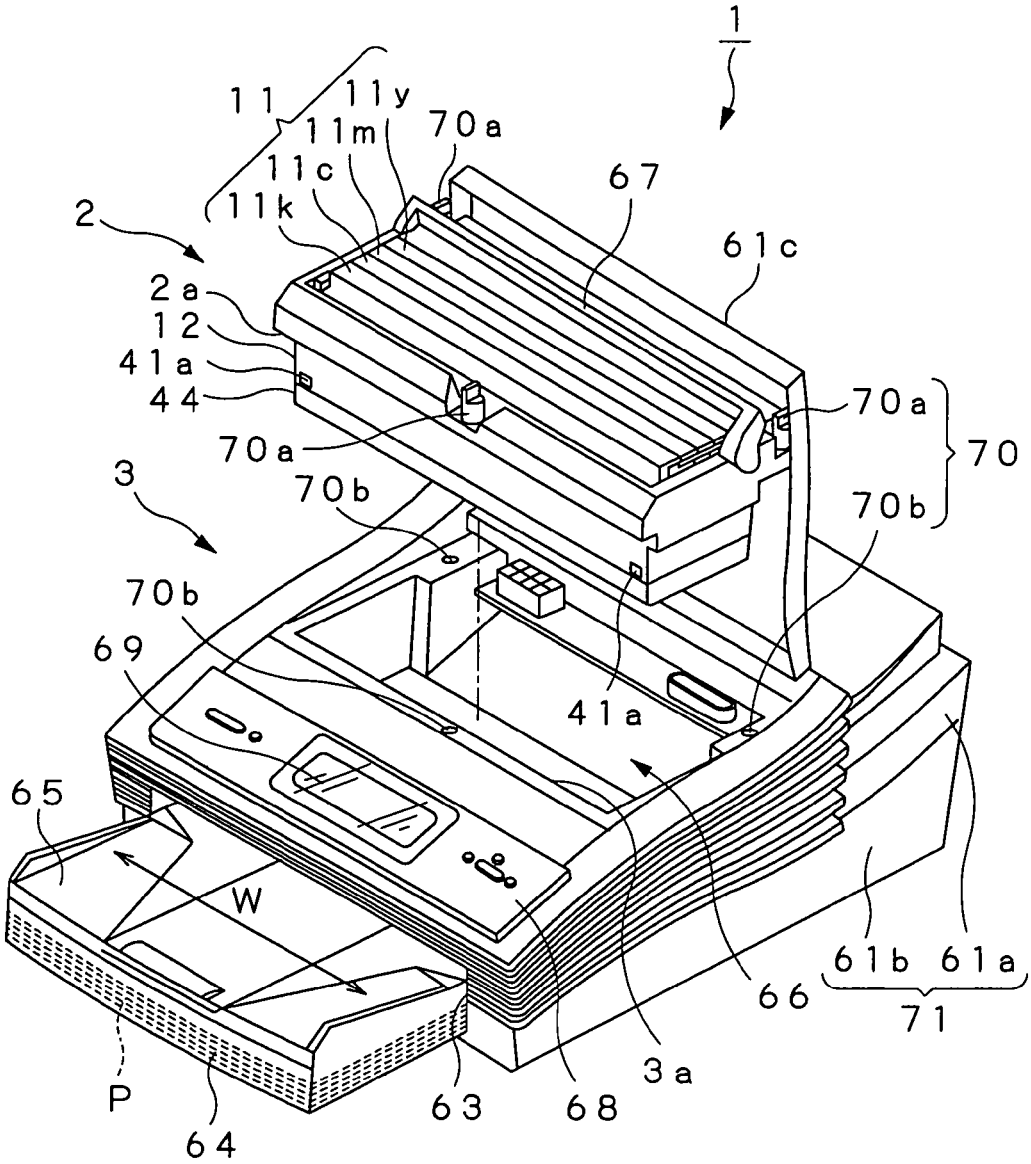
FIG. 3 is an exploded perspective view of a printer according to the first embodiment of the present invention.

Referring now to FIG. 3, there is schematically illustrated in the form of a block diagram an ink-jet printer, generally indicated with a reference numeral 1, according the first embodiment of the present invention. The printer 1 is to form graphics and characters on recording paper P by spraying ink or the like onto the paper P being carried in a predetermined direction. The printer 1 is a so-called line printer in which ink nozzles are arrayed in parallel with each other across the width of the paper P across the paper width, that is, in a straight line in the direction of arrow W in FIG. 3.

The printer 1 shown in FIG. 3 sprays and projects ink as droplets onto the recording paper P as an object being carried in the predetermined direction to record graphics and characters formed from ink dots on the paper P according to character data and graphic data supplied from an information processor such as personal computer, for example.

The printer 1 includes an inkjet print head cartridge (will be referred to as "head cartridge" hereunder) 2 which sprays ink 4, and a printer body 3 in which the head cartridge 2 is to be set. In the printer 1, the printer body 3 is designed for easy replacement of the head cartridge 2. The head cartridge 2 is a consumable and easy to set removably in the printer body 3.

First, there will be explained the head cartridge 2 removably settable in the printer body 3. The head cartridge 2 is a so-called line-printer head having a plurality of ink nozzles 52*a* disposed in a generally straight line across the width of the recording paper P in the direction of arrow W in FIG. 3.

Figure 4:
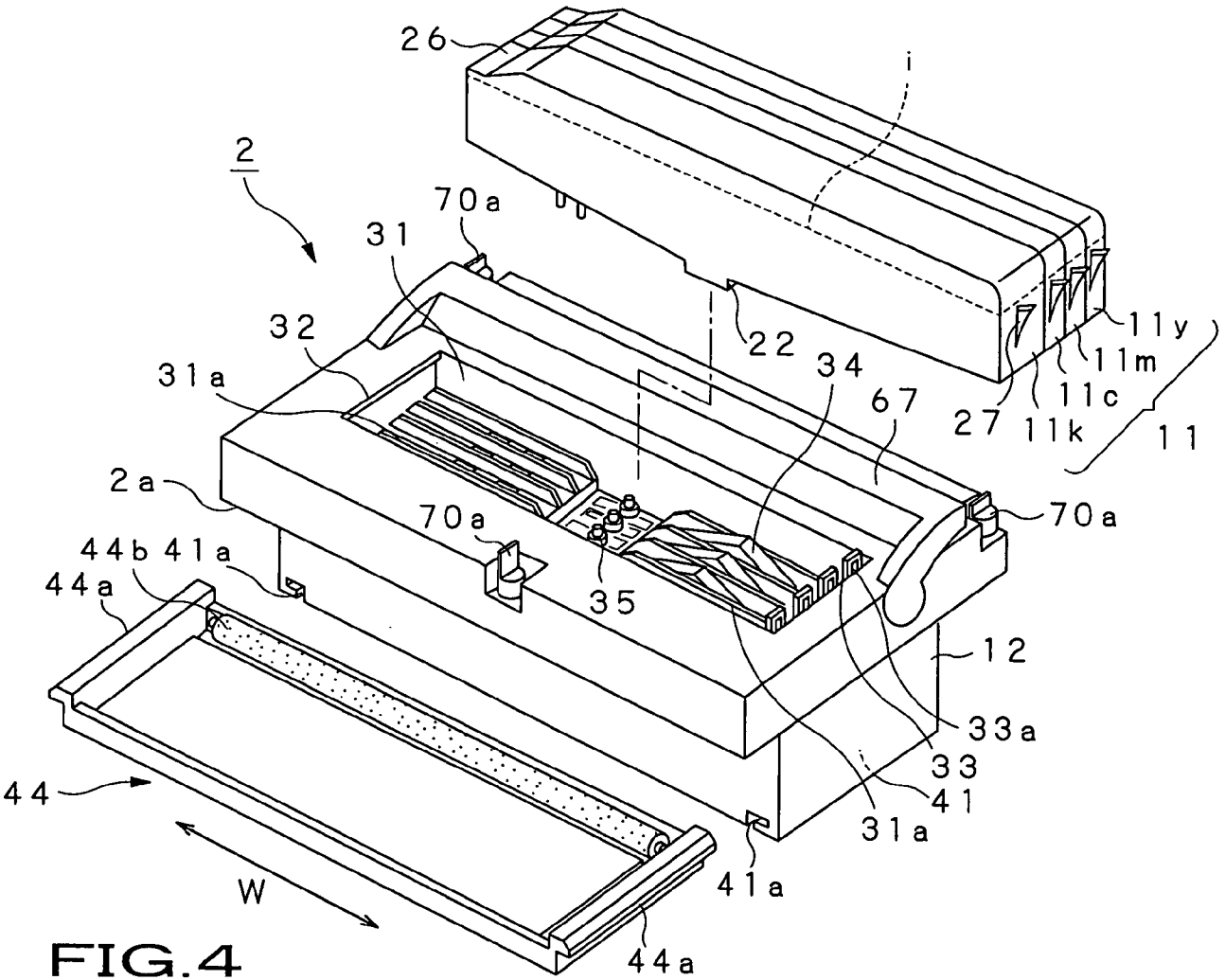
FIG. 4 is also an exploded perspective view of a print head cartridge in the printer shown in FIG. 3.

The head cartridge 2 includes a cartridge body 12 in which an ink tank 11 for ink i as shown in FIGS. 3 and 4 is received. In the cartridge body 12, there can be removably set ink tanks 11*y*, 11*m*, 11*c* and 11*k* containing yellow ink, cyan ink, magenta ink and black ink, respectively, for printing in colors.

The four ink tanks 11*y*, 11*m*, 11*c* and 11*k* are containers shaped each in the form of a cuboid by molding a synthetic resin or the like, and contain the ink i in such colors. The inner wall, which is in contact with the ink i, of the four ink tanks 11*y*, 11*m*, 11*c* and 11*k* is smaller in surface roughness than the outer surface to facilitate removal of fine foreign matters such as dust when cleaning the inner wall. The cuboidal form of the four ink tanks 11*y*, 11*m*, 11*c* and 11*k* is elongated correspondingly to the length of the long side of the cartridge body 12 in order to contain a larger amount of ink. These ink tanks 11*y*, 11*m*, 11*c* and 11*k* are arrayed in parallel with each other along the short side of the cartridge body 12. It should be noted that the following description is based on the assumption that the ink tanks 11*y*, 11*m*, 11*c* and 11*k* are disposed in sequence in a direction in which the recording paper P is carried.

Of the four ink tanks 11*y*, 11*m*, 11*c* and 11*k*, the ink tank 11*k* containing the black ink of which the consumption is largest is designed to have a larger capacity and a larger thickness than the other ink tanks 11*y*, 11*m* and 11*c*. It should be noted that these ink tanks 11*y*, 11*m*, 11*c* and 11*k* will be generically referred to as an ink tank 11 wherever appropriate in the following description.

Figure 5:
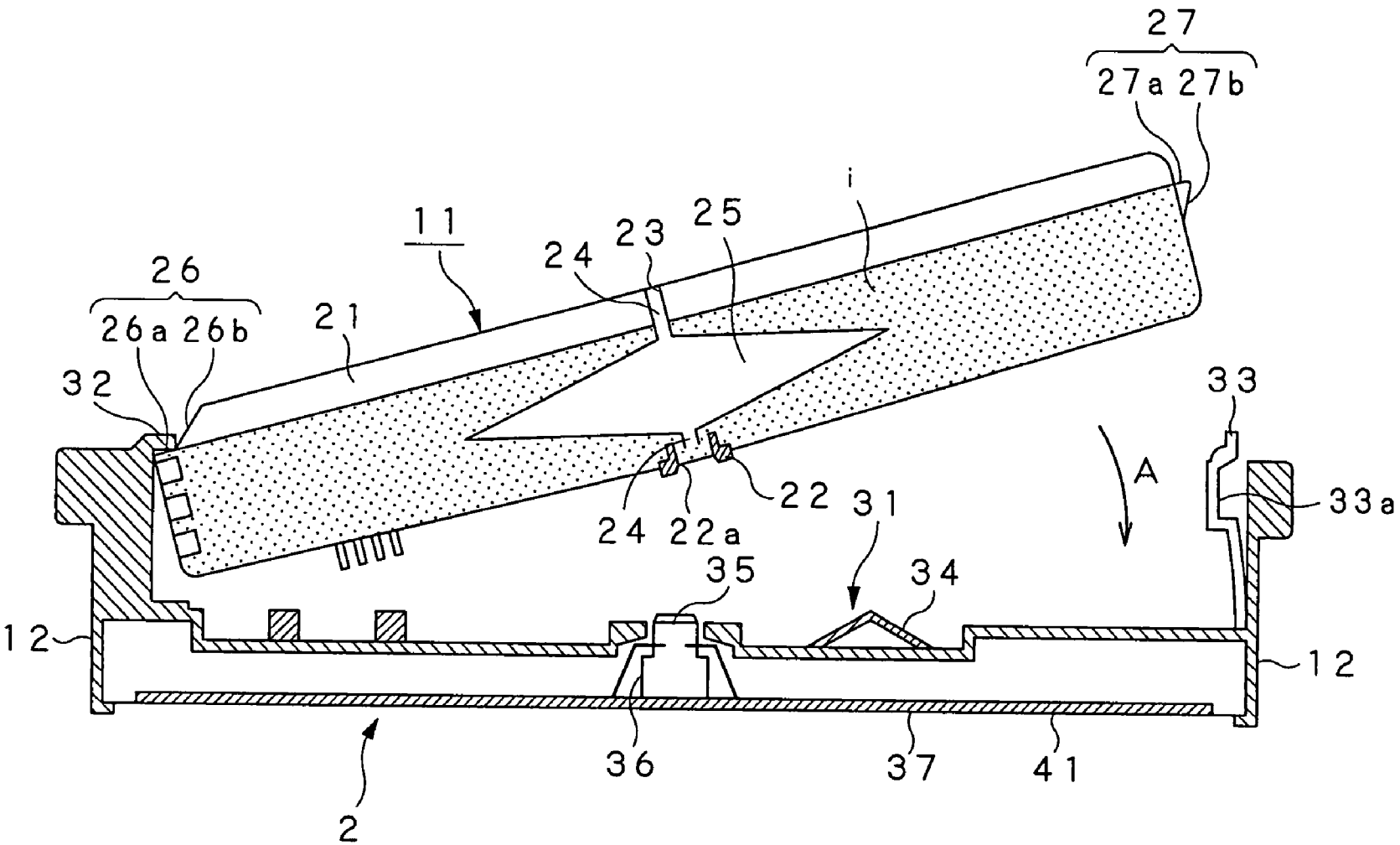
FIG. 5 is a sectional view of the printer in FIG. 3, showing an ink tank being set in the cartridge body.

As shown in FIGS. 4 and 5, the ink tank 11 containing the ink i includes an ink container 21 to contain the ink i, a liquid feeder 22 to feed the ink i from the ink container 21 to the cartridge body 12, an outside communication hole 23 to communicate the ink container 21 with outside, and an air inlet tube 24 to introduce outside air into the ink container 21 through the communication hole 23.

The ink container 21 has a space to be filled with ink i, and is shaped correspondingly to the contour of the ink tank 11 to contain an amount of ink i as large as possible.

Also, the ink container 21 is designed for the bottom thereof to be deepest at the ink feeder 22 located nearly at the center and for the ink i contained inside to gather into the ink feeder 22.

The ink feeder 22 is a nozzle to supply the ink i from the ink tank 11 communicating with the ink container 21 to the cartridge body 12 and it is projected downward from the bottom center of the ink container 21. The ink feeder 22 is increased in inside diameter toward the end thereof so that it can smoothly be fitted on a coupler 35 of the cartridge body 12 that will be described in detail later.

The outside communication hole 23 is formed in the top center of the ink container 21 as shown in FIG. 5. The outside communication hole 23 is closed with a breathable sealing member (not shown). Thus, the ink tank 11 prevents the ink i from leaking from the outside communication hole 23 to outside and dust or the like from entering the ink container 21 when outside air is taken in via the outside communication hole 23.

The air inlet tube 24 is provided extending from the outside communication hole 23 downward into the ink container 21. Thus, in the ink tank 11, when the ink i is fed from the ink feeder 22 to the cartridge body 12, an amount of air corresponding to a resultant decrease of the ink i in the ink container 21 will be taken into the ink container 21 from the outside communication hole 23 via the air inlet tube 24.

Also, in the middle of the air inlet tube 24, there is provided an ink well 25 for temporary stay of the ink i to prevent the ink i having reversely flowed from the ink container 21 from suddenly flowing out of the outside communication hole 23. The ink well 25 is defined by a void shaped to have a rhombic section and whose longer diagonal as viewed from the front is parallel to the length of the ink container 21. The top corner of the ink well 25 communicates with the outside communication hole 23 via the air inlet tube 24 and the bottom corner communicates with the ink container 21 via the air inlet tube 24. Thus, in the ink tank 11, the ink i having reversely flowed from the ink container 21 via the air inlet tube 24 can temporarily be reserved in the ink well 25 against leakage to outside from the outside communication hole 23 and can be returned to the ink container 21.

As shown in FIGS. 4 and 5, the above ink tank 11 includes an engagement step 26 and locking projection 27, which serve together as a means for fastening the ink tank 11 to a tank receptacle 31 of the cartridge body 12 that will be described in detail later.

The engagement step 26 is formed at one longitudinal end of the ink tank 11. It includes a horizontal portion 26*a* extending from the lateral side at that end in parallel with and one step below the top surface of the ink tank 11, and an inclined portion 26*b* extending obliquely from the horizontal portion 26*a* toward the top surface of the ink tank 11.

The locking projection 27 is formed to project from the lateral side at the other longitudinal end of the ink tank 11. It includes a horizontal portion 27*a* extending in parallel with the top surface of the ink tank 11 and an inclined portion 27*b* extending below the horizontal portion 27*a* and obliquely toward that lateral side.

On the other hand, the tank receptacle 31 of the cartridge body 12 has received therein the ink tanks 11*y*, 11*m*, 11*c* and 11*k* each containing the aforementioned colored ink as shown in FIGS. 4 and 5.

The tank receptacle 31 is a concavity formed in the cartridge body 12 formed in the generally cuboidal shape across the width of the recording paper P to be sufficiently deep for reception of the ink tanks 11*y*, 11*m*, 11*c* and 11*k* from the top of the cartridge body 12. The tank receptacle 31 is partitioned by partition walls 31*a* at the bottom thereof to give specific spaces to the ink tanks 11*y*, 11*m*, 11*c* and 11*k*, respectively, placed side by side along the short side of the cartridge body 12.

Since the ink tank 11*k* for the black ink is larger in thickness than the other ink tanks 11*y*, 11*m* and 11*c*, the interval between the partition walls 31*a* to define a mounting space for the ink tank 11*k* is a predetermined width larger than that between the partition walls 31*a* for defining a mounting space for each of the other ink tanks 11*y*, 11*m* and 11*c* in the tank receptacle 31 as well.

The tank receptacle 31 has a retainer 32, latch levers 33 and leaf springs 34, which cooperate with each other to securely retain the ink tanks 11 in the ink mount 31.

As best shown in FIG. 5, the retainer 32 overhangs to a predetermined width longitudinally from the one longitudinal end of the tank receptacle 31 and retains the horizontal portion 26*a* of the engagement step 26 formed on the ink tank 11.

The latch lever 33 is an elastic moving piece projecting upward from the bottom corner at the other longitudinal end of the tank receptacle 31. Its free end is elastically movable in a direction toward and away from the lateral side of the tank receptacle 31. In the free end portion of the latch lever 33, there is formed a locking hole 33*a* in which the locking projection 27 of the ink tank 11 is to be engaged. In the tank receptacle 31 partitioned by the partition walls 31*a*, latch levers 33 for the ink tanks 11*y*, 11*m*, 11*c* and 11*k* are provided side by side along the short side of the cartridge body 12.

The leaf springs 34 are provided on the bottom of the tank receptacle 31 to force the ink tank 11 set in the tank receptacle 31 upward. The leaf springs 34 are disposed longitudinally of the tank receptacle 31. Each of the leaf spring 34 is fixed at one end thereof to the bottom of the tank receptacle 31 and has the middle portion thereof bent upward. On the bottom of the tank receptacle 31 partitioned by the partition walls 31*a*, the lead springs 34 for the ink tanks 11*y*, 11*m*, 11*c* and 11*k* are disposed side by side along the short side of the cartridge body 12.

For mounting the ink tank 11 into the tank receptacle 31, its one end with the engagement step 26 is first inserted obliquely into the tank receptacle 31, and then with the horizontal portion 26*a* of the engagement step 26 being put under the retainer 32 of the tank receptacle 31, the other end with the locking projection 27 is inserted into the tank receptacle 31 while being turned in the direction of arrow A in FIG. 5. At this time, the locking projection 27 of the ink tank 11 abuts, at the inclined portion 27*b* thereof, the latch lever 33 to elastically move the latch lever 33 toward the lateral side of the tank receptacle 31.

Figure 6:
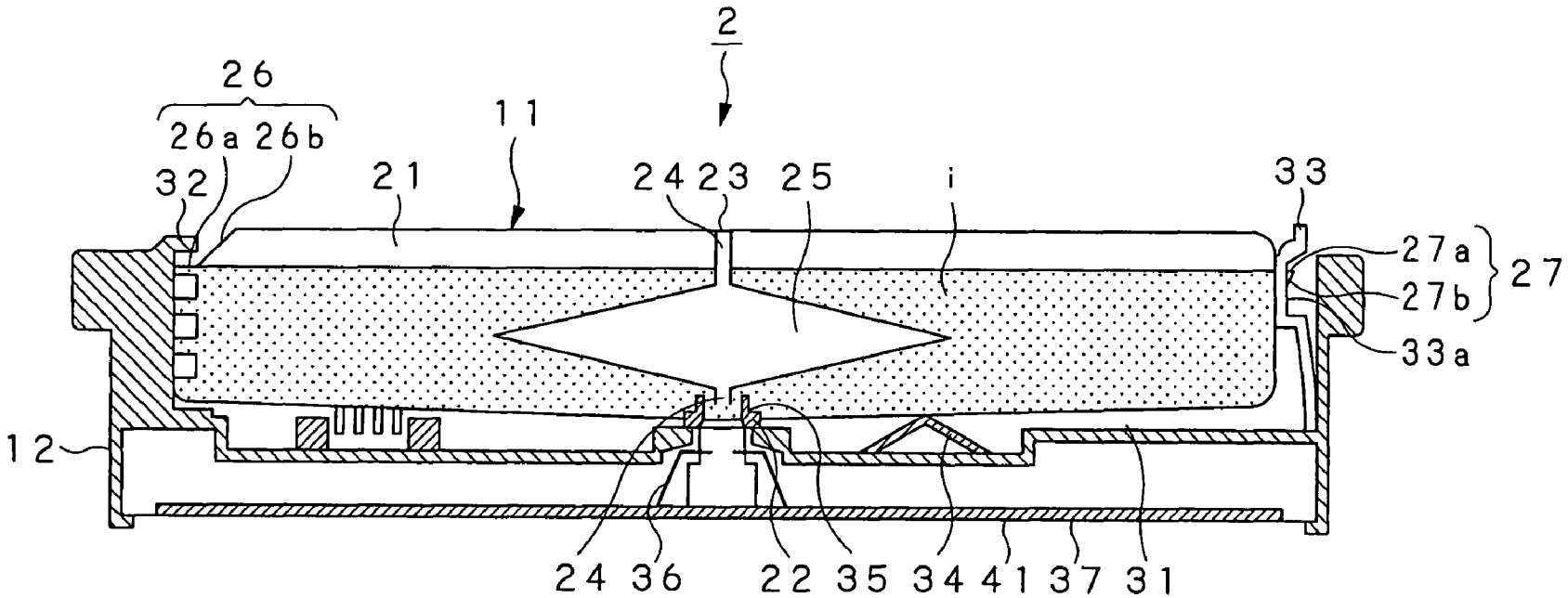
FIG. 6 is also a sectional view of the print head cartridge.

Upon reception of the ink tank 11 in the tank receptacle 31, the locking projection 27 is engaged into the locking hole 33*a* in the latch lever 33 as shown in FIG. 6. At this time, the latch lever 33 presses, at the free end thereof, the lateral side of the ink tank 11 set in the tank receptacle 31 while the leaf springs 34 provided on the bottom of the tank receptacle 31 press the bottom of the ink tank 11 upward, so that the horizontal portion 26*a* of the engagement step 26 will be engaged on the retainer 32 of the tank receptacle 31 while the horizontal portion 27*a* of the locking projection 27 is engaged in the locking hole 33*a* in the latch lever 33. Thus, the ink tank 11 can appropriately be immobilized in the tank receptacle 31 of the cartridge body 12.

On the other hand, for removing the ink tank 11 from inside the tank receptacle 31, the free end of the latch lever 33 is elastically moved away from the lateral side of the ink tank 11. Thus, the horizontal portion 27*a* of the locking projection 27 is disengaged from the locking hole 33*a* in the latch lever 33. At this time, the leaf springs 34 press the bottom of the ink tank 11 upward in the direction of arrow A in FIG. 5 as shown in FIG. 3, and the ink tank 11 can thus be taken out of the tank receptacle 31.

Figure 7:
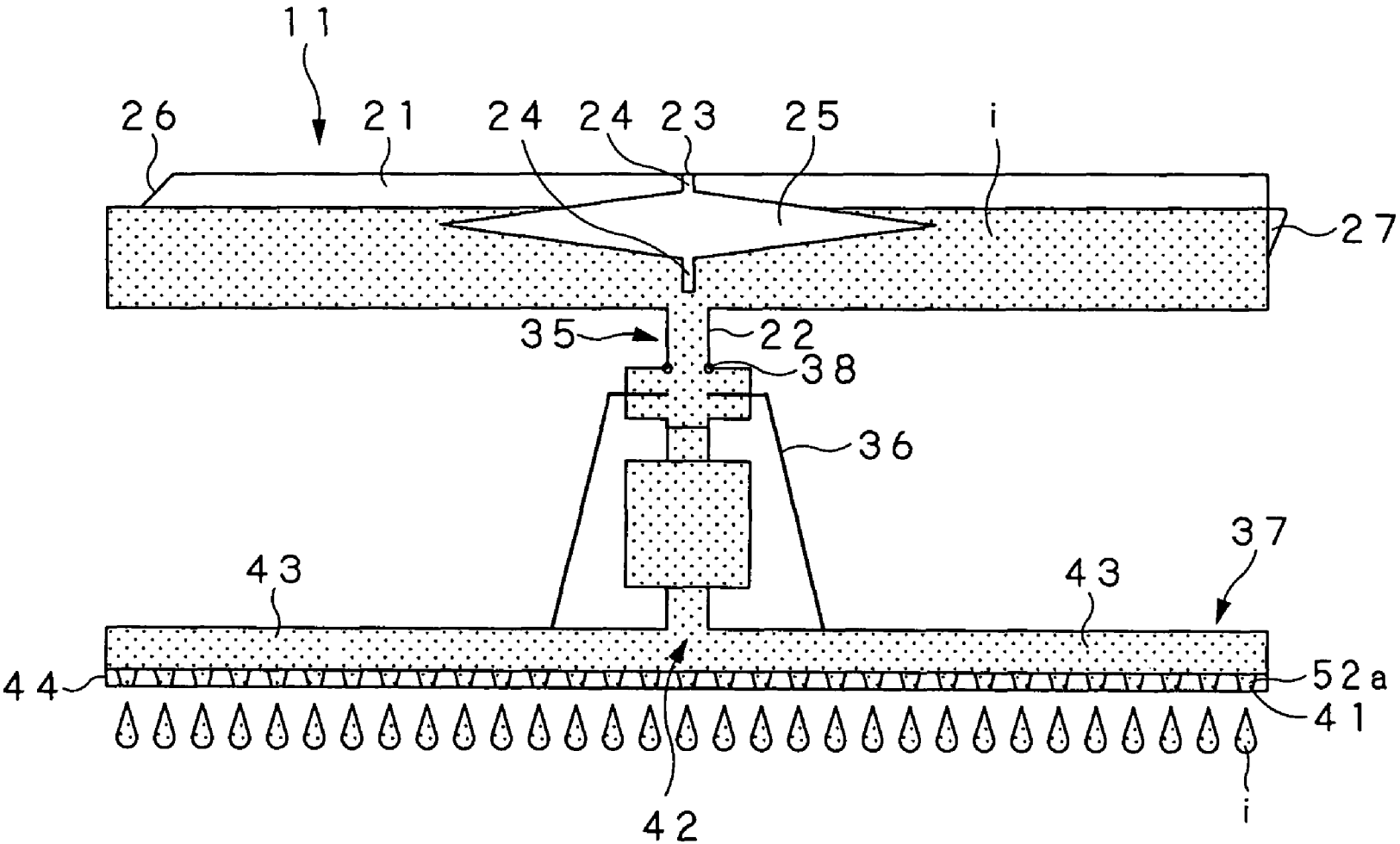
FIG. 7 is a sectional view showing the substantial part of the print head cartridge.

As shown in FIGS. 6 and 7, the cartridge body 12 in which the ink tank 11 is received includes the aforementioned coupler 35 which is to be connected to the ink feeder 22 of the ink tank 11, an ink dispenser 36 to dispense the ink i from the ink tank 11 connected to the coupler 35, and a head 37 to spray the ink i supplied or dispensed from the ink dispenser 36.

The coupler 35 is a nozzle provided in the bottom center of the tank receptacle 31. With the free end being fitted into the aforementioned ink feeder 22, the coupler 35 is connected to the ink feeder 22 of the ink tank 11. When the ink feeder 22 of the ink tank 11 is connected to the coupler 35, an opening/closing pin (not shown) provided in the free end of the coupler 35 opens the ink feeder 22. Also, the coupler 35 has provided thereon a sealing member 38 such as O-ring to prevent the ink i from leaking from between the coupler 35 and ink feeder 22.

Note that the free end of the coupler 35 may also be designed to serve as an opening/closing pin. More specifically, the free end of the coupler 35 may be designed for fitting into the ink feeder 22 to open the latter. Also, the free end of the coupler 35 may be tapered to have the diameter thereof reduced as it goes toward the end for smooth fitting into the ink feeder 22.

In the bottom center of the tank receptacle 31 partitioned by the partition walls 31*a*, the couplers 35 for the ink tanks 11*y*, 11*m*, 11*c* and 11*k* are disposed side by side along the short side of the cartridge body 12.

The ink dispenser 36 is a valvular mechanism whose valve (not shown) is opened under the action of a negative pressure produced when the ink i is sprayed from the nozzles 52*a* of the head 37 that will be described in detail later. Thus, the ink i is supplied from the ink container 21 of the ink tank 11 to the head 37. When the ink i is supplied from the ink container 21 of the ink tank 11 to the head 37 and hence the pressure in the head 37 returns to the normal level, the valve will be closed to stop supply of the ink i from the ink container 21 of the ink tank 11 to the head 37.

Each time the ink i is sprayed from the nozzles 52*a* of the head 37 that will be described in detail later, the ink dispenser 36 will repeatedly dispense the ink i. On the other hand, in the ink tank 11, when the ink i in the ink container 21 is supplied to the ink dispenser 36 each time the ink i is dispensed from the aforementioned ink dispenser 36, the amount of the ink i in the ink container 21 will decrease and hence an amount of air corresponding to the decrease of the amount of the ink i be introduced into the ink container 21 from the outside communication hole 23 via the air inlet tube 24. Thus, the ink i can appropriately be supplied to the ink dispenser 36 while the pressure in the ink container 21 is being kept in equilibrium.

Note that the ink dispensers 36 are provided below the couplers 35 for the colored-ink tanks, respectively.

The head 37 includes an ink-praying surface 41 having formed thereon the nozzles 52*a* that spray the ink i as droplets, which will be described in detail later, an ink port 42 provided above the ink-spraying surface 41 and which is supplied with the ink i from the ink dispenser 36, an ink channel 43 that guides the ink i supplied from the ink port 42 to each nozzle, and a head cap 44 to protect the ink-spraying surface 41.

The ink-spraying surface 41 has a plurality of the nozzles 52*a* disposed side by side thereon in a generally straight line across the width of the recording paper P. The ink port 42 is provided in the top center of the ink channel 43 to communicate with the ink dispenser 36. The ink channel 43 is formed nearly straight across the width of the paper P for each nozzle 52*a* to be supplied with the ink i.

As will seen from FIGS. 3 and 4, the head cap 44 is a cover provided to protect the ink-spraying surface 41. At the time of printing, the head cap 44 moves from on the ink-spraying surface 41. The head cap 44 includes a pair of engagement projections 44*a* formed at opposite ends, in the direction of arrow W in FIG. 4, of the head cap 44 to extend in the opening/closing direction, and a cleaning roller 44*b* provided longitudinally of the head cap 44 to remove excessive ink i from on the ink-spraying surface 41. The head cap 44 is engaged at the engagement projections 44*a* thereof in a pair of engagement recesses 41*a* formed in a direction nearly perpendicular to the direction of arrow W in FIG. 4, and can thus be opened and closed along the pair of engagement recesses 41*a* in a direction along the short side of the ink tank 11, that is, in the direction nearly perpendicular to the direction of arrow W in FIG. 4. When the head cap 44 is opened or closed, the cleaning roller 44*b* is rotated in contact with the ink-spraying surface 41 to remove excessive ink i, thereby cleaning the ink-spraying surface 41. The cleaning roller 44*b* is formed from a highly hygroscopic material such as nonwoven fabric, woven textile the like. Also, when no printing is done, the head cap 44 closes the ink-spraying surface 41 to prevent drying of the ink i exposed from the nozzle 52*a* of the ink-spraying surface 41.

The head 37 constructed as above additionally includes a plurality of ink-praying heads 45, which is in pair with a predetermined number of the nozzles 52*a*. The ink-spraying heads 45 are arranged in a staggered format. More particularly, the ink-spraying heads 45 are disposed in a staggered arrangement across the width of the recording paper P with the ink channel 43 between laid between the heads 45 and nozzles 52*a*.

Figure 8:
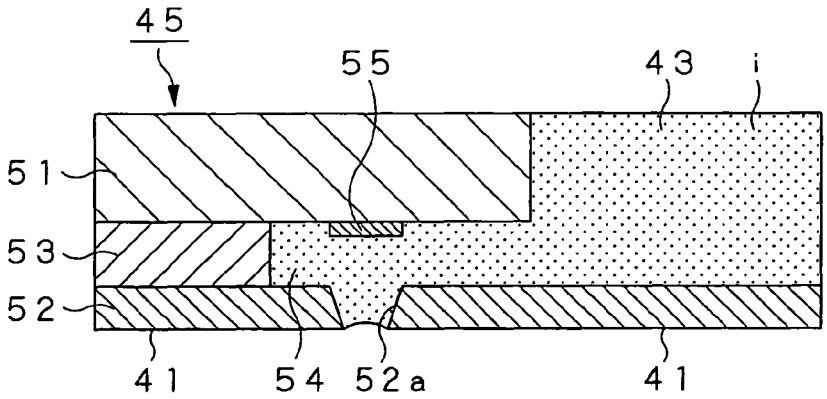
FIG. 8 is a sectional view of an ink-spraying head in the print head cartridge.

As shown in FIG. 8, the ink-spraying head 45 includes a circuit board 51 serving as a base, a nozzle sheet 52 having a plurality of nozzles 52*a* formed therein, a film 53 provided between the circuit board 51 and nozzle sheet 52 to define a zone for each nozzle 52*a*, an ink well 54 to pressurize the ink i supplied through the ink channel 43, and a resistance heater 55 to heat the ink i supplied to the ink well 54.

The circuit board 51 is a control circuit formed from a logic IC (integrated circuit), driver transistor and the like mounted on a semiconductor wafer of silicon or the like. It also forms the top of the ink well 54.

The nozzle sheet 52 has formed thereon the nozzle 52*a* reduced in diameter as it goes toward the ink-spraying surface 41 to have a diameter of some 20 μm at the side of the ink-spraying surface 41, and is disposed opposite to the circuit board 51 with the nozzle film 53 being laid between them to form the lateral side of the ink well 54.

The film 53 is a photo-curable dry film resist. It is formed around each nozzle 52*a* except for a portion communicating with the ink channel 43. Also, the film 53 is interposed between the circuit board 51 and nozzle sheet 52 to form the lateral side of the ink well 54.

The ink well 54 is surrounded by the aforementioned circuit board 51, nozzle sheet 52 and film 53 to form, for each nozzle 53*a*, a pressurizing space in which the ink i supplied from the ink channel 43 is pressurized.

The resistance heater 55 is disposed on the circuit board 51 facing the ink well 54 and is electrically connected to the control circuit and the like provided on the circuit board 51. The resistance heater 55 generates heat under the control of the control circuit and the like to heat the ink i in the ink well 54.

Figure 9A:
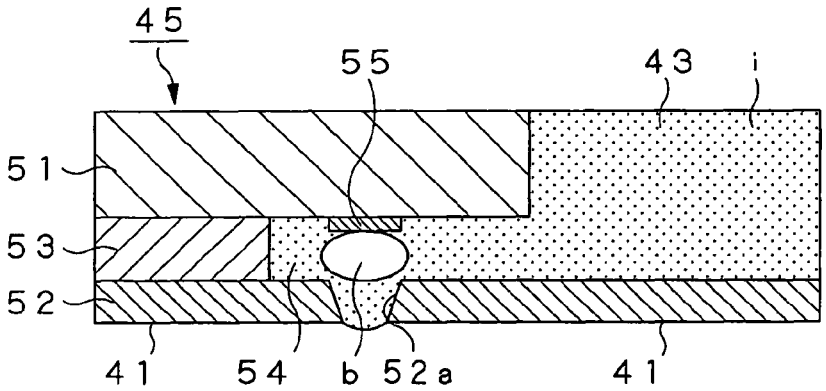
Figure 9B:
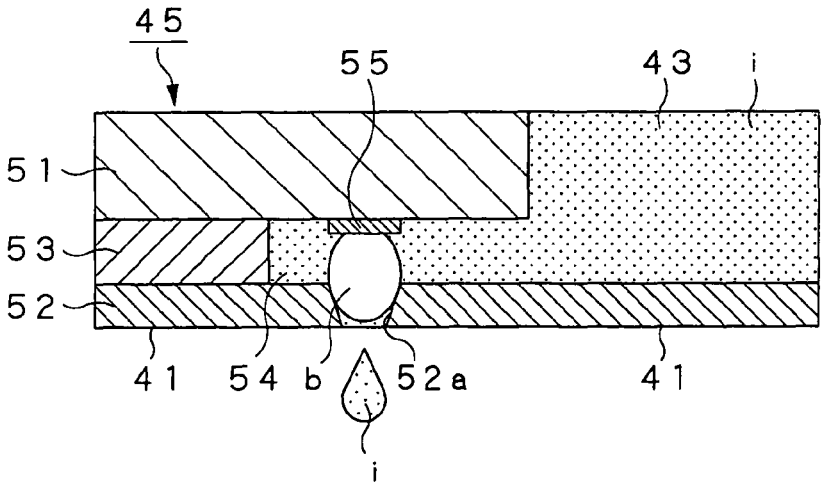

In the ink-spraying head 45, the control circuit on the circuit board 51 selects one of the resistance heaters 55 and supplies a pulse current to the selected resistance heater 55 for a time length of about 1 to 3 microseconds, for example. Thus, the ink-spraying head 45 is rapidly heated by the resistance heater 55. In the ink-spraying head 45, a bubble b is produced in the ink well 54 facing the resistance heater 55 as shown in FIG. 9A. In the ink well 54 in the ink-spraying head 45, the bubble b will be inflated to pressurize the ink i and the ink i thus pressed be sprayed as droplets from the nozzle 52*a* as shown in FIG. 9B. After the ink droplets are sprayed as above, the ink i is supplied to the ink well 54 via the ink channel 43. Thus, the ink-spraying head 45 will restore the state which is before the ink is sprayed.

The ink-spraying head 45 is formed by forming the film 53 over the main surface of the circuit board 51, shaping the film 53 into a form corresponding to the ink well 54 by the photolithography, and then laminating the nozzle sheet 52 on the film 53 so formed.

Also, the aforementioned ink-spraying head 45 adopts an electrothermal transducing process in which the ink i is heated by the resistance heater 55 for spraying. However, the ink-spraying head 45 is not limited to the use of this process but may adopt an electromechanical transducing process in which droplets of the ink i are sprayed electromechanically by an electromechanical transducing element such as piezzoelectric element, for example.

Note that the head 37 is provided under the aforementioned ink dispenser 36 for each color. On the bottom of the cartridge body 12, the ink-spraying surfaces 41 of the heads 37 for the ink tanks 11*y*, 11*m*, 11*c* and 11*k* are arranged side by side along the short side of the cartridge body 12 to form a continuous ink-spraying surface 41.

The head cartridge 2 constructed as above includes, in addition to the above-mentioned components, an ink remaining-amount detector (not shown) to detect the remaining amount of ink i in the ink container 12, an ink tank discriminator (not shown) to discriminate among the ink tanks 11*y*, 11*m*, 11*c* and ilk, etc.

Next, there will be illustrated and described the printer body 3 in which the head cartridge 2 constructed as above is to be installed.

As shown in FIG. 3, the printer body 3 includes an outer housing 61 consisting of an upper housing 61*a* and lower housing 61*b* to prevent dust or the like from coming into the printer body 3.

Figure 10:
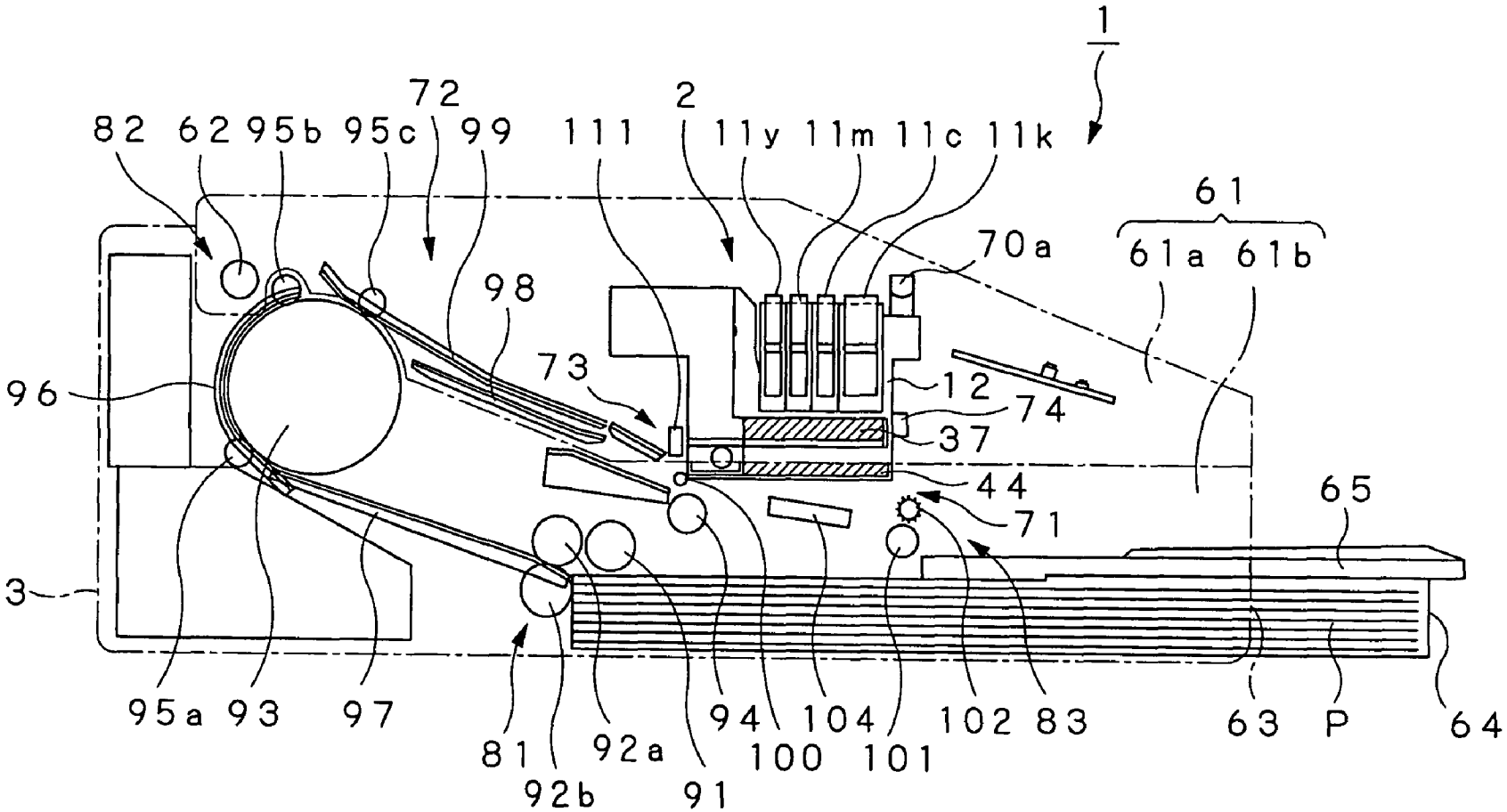
FIG. 10 is a perspective side elevation of a liquid sprayer.
Figure 11:
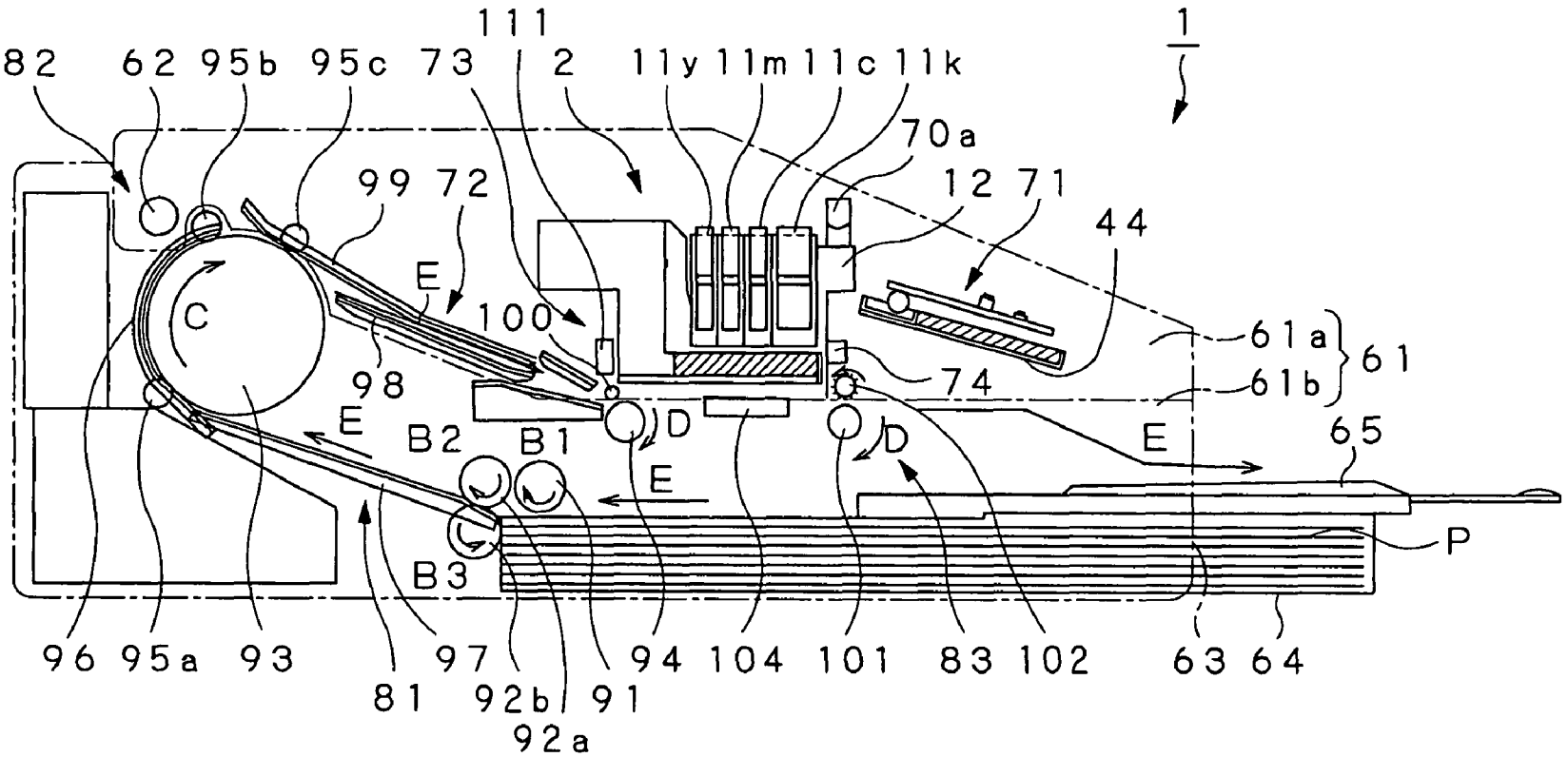
FIG. 11 is also a perspective side elevation explaining how the liquid sprayer works.

Also, in the printer body 3, a pair of spindles 62 provided at opposite lateral sides of the upper housing 61*a* is pivoted in a frame (not shown) inside the lower housing 61*b* as shown in FIGS. 10 and 11 to permit the front side of the upper housing 61*a* to be opened an closed in relation to the lower housing 61*b* at the front of the outer housing 61.

Also, the outer housing 61 has formed in the front side thereof a paper inlet/outlet 63 through which the recording paper P is fed and delivered as shown in FIG. 3. With a paper tray 64 containing recording paper P being inserted into the paper inlet/outlet 63, the paper P can be fed. The paper P will be delivered onto a lid tray 65 which is closing the front half of the opening of the paper tray 64 through the paper inlet/outlet 63.

On the upper housing 61*a*, there is provided a head receptacle 66 in which the aforementioned head cartridge 2 is to be received. When the head cartridge 2 is set in the head receptacle 66, the ink-spraying surface 41 of the head cartridge 2 will face the printing position in the lower housing 61*b*, which will be described in detail later. It should be noted that a handle 67 is installed to the head cartridge 2 as shown in FIG. 4. Thus, the head cartridge 2 can easily be set in and removed from the head receptacle 66 at the time of replacement.

Also, the upper housing 61*a* has installed thereto a lid 61*c* covering the head receptacle 66 as shown in FIG. 3. Namely, the lid 61*c* can be opened from, and closed to, the head receptacle 66. When the lid 61*c* closes the head receptacle 66, it forms an upper surface contiguous to the upper housing 61*a*. Also, the lid 61*c* can be closed even with the head cartridge 2 being set in the head receptacle 66.

Further, a display panel 69 and control buttons 68 for various operations are provided on the upper surface of the upper housing 61*a* at the front side where the recording paper P is fed and delivered, which will be described in detail later. The display panel 69 displays a state of printing etc.

Further, on the upper surface of the upper housing 61*a*, there is provided a head cartridge supporting mechanism 70 for supporting the head cartridge 2 set in the head receptacle 66 to be removable from the latter. More specifically, the head cartridge supporting mechanism 70 can position, support and secure the head cartridge 2 in relation to the upper housing 61*a* by engaging knobs 70*a* provided on the head cartridge 2 on forcing members such as spring (not shown) into locking holes 70*b* formed in the top edge of the head receptacle 66 so that a reference face 3*a* (top edge) formed on the head receptacle 66 of the printer body 3 will abut a peripheral edge face 2*a* of the head cartridge 2. Thus, the ink-spraying surface 41 of the cartridge body 12 can be positioned opposite and parallel to, and with a predetermined distance from, the main side of the recording paper P carried to the printing position by a paper feed/delivery mechanism 72 which will be described in detail later.

As shown in FIGS. 10 and 11, the printer body 3 further includes a head cap operating mechanism 71 to open and close the head cap 44 installed to the ink-spraying surface 41 of the head cartridge 2 when set in the head receptacle 66, the paper feed/delivery mechanism 72 to feed the recording paper P to the head 37 or eject it out of the latter by carrying it in a predetermined direction, a paper speed discrimination unit 73 to judge whether the carrying speed of the paper P has been changed to another speed, and a temperature sensor 74 to detect the ambient temperature around the head 37 at the time of spraying the ink i.

The head cap operating mechanism 71 includes a drive unit to operate the head cap 44 of the head cartridge 2 as will be described below. Namely, for printing, the drive unit moves the head cap 44 from on the ink-spraying surface 41 so that the ink-spraying head 45 is exposed to the recording paper P. After completion of the printing, the drive unit moves the head cap 44 to cover the ink-spraying surface 41 in order to protect the ink-spraying head 45 and prevent the ink i from being dried.

As shown in FIGS. 10 and 11, the paper feed/delivery mechanism 72 is to carry the recording paper P in the predetermined direction to feed the paper P to the head cartridge 2 and deliver the paper P printed by the head cartridge 2 to outside. More specifically, the paper feed/delivery mechanism 72 includes a paper feeder 81 to feed the paper P into the printer body 3, a paper carrier 82 to carry the paper P fed from the paper feeder 81 to the printing position, and a paper delivery unit 83 to deliver the paper P carried by the paper carrier 82 to outside.

To feed the recording paper P from the paper tray 64 to the paper carrier 82, the paper feeder 81 includes a feed roller 91 to feed the paper P in the paper tray 64 to the paper carrier 82, and a pair of separation rollers 92*a* and 92*b* to move the paper P fed by the feed roller 91 one by one to the paper carrier 82. These elements are rotated simultaneously with each other in the directions of arrows B1, B2 and B3 in FIG. 11 by a drive mechanism (not shown) provided inside the lower housing 61*b*.

The feed roller 91 is disposed above the recording paper P exposed through the open rear end of the paper tray 64 and can be put at the outer surface thereof into touch with the paper P pushed up by a paper push-up mechanism (not shown) provided inside the paper tray 64.

The separation rollers 92*a* and 92*b* in pair are disposed near the rear of the feed roller 91 and rotated in the same direction while nipping, between them, the recording paper P fed by the feed roller 91. Thus, even when the feed roller 91 has fed two sheets of paper P, for example, erroneously at the same time, one (92*a*) of the separation rollers 92*a* and 92*b* will forward one of the paper sheets P to the paper carrier 82 while the other separation roller (92*b*) will move the other paper P back to the paper tray 64 at the front side of the printer body 3, whereby only one paper P can be fed to the rear side of printer body 3.

The carrier 82 is to carry the recording paper P from the paper feeder 81 to the paper delivery unit 83. It includes a divert roller 93 to divert the paper P, and a feed roller 94 to bring the paper diverted by the divert roller 93 to the printing position.

The divert roller 93 is disposed at the rear side in the printer body 3, and rotated in the direction of arrow C in FIG. 11 by a drive mechanism (not shown) provided inside the lower housing 61*b*. Also, at the rear side of the divert roller 93, there are provided a pair of pressing rollers 95*a*, 95*b* and 95*c* to press the recording paper P diverted over the outer surface of the divert roller 93, and a curved first limit plate 96 located opposite to the outer surface of the divert roller 93 to limit the movement of the paper P.

Between the divert roller 93 and pair of separation rollers 92*a* and 92*b*, a first guide plate 97 is provided at the side of the lower housing 61*b* to guide the recording paper P. In addition, between the divert roller 93 and feed roller 94, a second guide plate 98 to guide the paper P and a planar second limit plate 99 located opposite to the second guide plate 98 to limit the movement of the paper P are provided at the side of the upper housing 61*a*.

The feed roller 94 is disposed upstream in the carrying direction of the recording paper P in relation to the head 37, that is, at the side of the divert roller 93 and at the lower housing 61*b* in relation to the paper P to be carried. While being rotated about its own axis in contact with one main surface of the paper P opposite to the other main surface on which printing is to be made, the feed roller 94 carries the paper P.

At the side of the upper housing 61*a* of the feed roller 94, there is provided a press roller 100 located opposite to the feed roller 94 to press the recording paper P to the feed roller 94. Thus, the paper P is put by the press roller 100 into contact with the feed roller 94 and appropriately nipped by the outer surface of the feed roller 94, and appropriately carried to the printing position opposite to the ink-spraying surface 41. It should be noted that the press roller 100 is rotatable about its own axis as the paper P is carried.

As shown in FIGS. 10 and 11, the paper delivery unit 83 includes a delivery roller 101 to carry the recording paper P having a print made by the head 37 toward the paper inlet/outlet 63, and a spur 102 provided opposite to the delivery roller 101.

The delivery roller 101 is disposed downstream in the carrying direction of the recording paper P in relation to the head 37, that is, at the side of the paper inlet/outlet 63 and at the side of the lower housing 61*b* in relation to the recording paper P to be carried. While being rotated about its own axis in contact with one main surface of the paper P opposite to the other main surface on which printing is to be made, the delivery roller 101 carries the paper P.

The spur 102 is disposed opposite to the delivery roller 101 at the side of the upper housing 61 to have a point contact with the printed surface of the recording paper P for least possible transfer of the printed ink and forward the paper P from between the spur 102 ad delivery roller 101 onto the lid tray 65 at the side of the paper inlet/outlet 63. It should be noted that the spur 102 is rotatable about its own axis as the paper P is carried.

Figure 12:
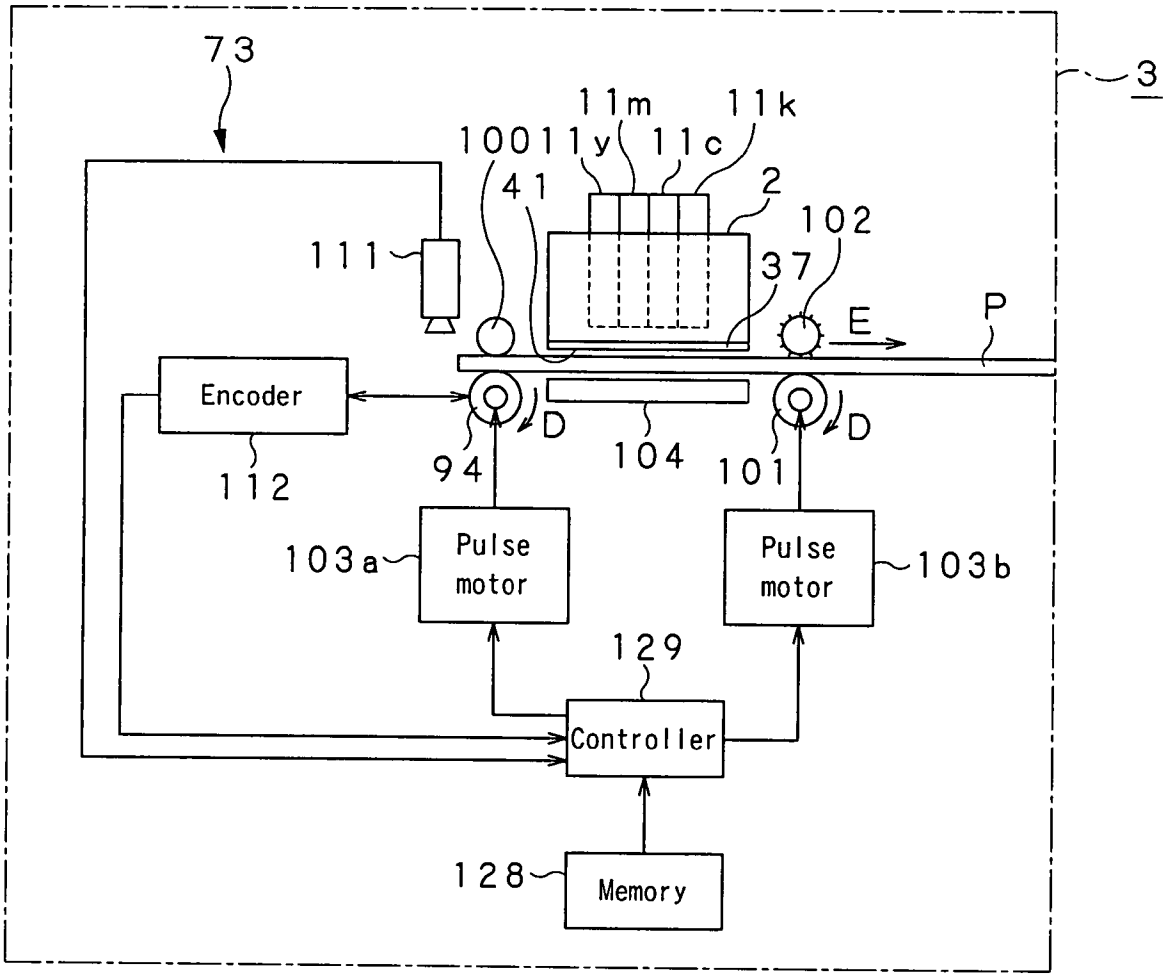
FIG. 12 explains rollers which keep the recording paper tight in a paper feed/delivery mechanism of the liquid sprayer.

In the paper feed/delivery mechanism 72 constructed as above, the feed roller 94 and delivery roller 101 are connected to pulse motors 103*a* and 103*b*, respectively, by means of belt pulleys (not shown) for endless belt, for example, and thus driven by the pulse motors 103*a* and 103*b*, respectively, as shown in FIG. 12. The feed and delivery rollers 94 and 101 are rotated about their own axes in the direction of arrow D to carry the recording paper P having been carried by the divert roller 93 toward the paper inlet/outlet 63.

These feed and delivery rollers 94 and 101 are rotated at different speeds, respectively. The speed of each roller is controlled with the frequency of a pulse current supplied to each of the pulse motors 103*a* and 103*b*. More specifically, the feed roller 94 is rotated at a speed to carry the recording paper P having been carried in the direction of arrow E in FIG. 12 to the printing position and the delivery roller 101 is rotated at a higher speed for delivering the printed paper P.

Thus, in the paper feed/delivery mechanism 72, the recording paper P can be kept tight without any sagging in the carrying direction when making a print on the paper P being carried to a position opposite to the ink-spraying surface 41 of the head 37. Therefore, in the paper feed/delivery mechanism 72, since the paper P having arrived at the printing position is prevented from being sagged or flexed, it is possible to always keep constant the distance between the ink-spraying surface 41 of the head 37 and main surface of the paper P. It should be noted that the frequency of a pulse current supplied to the pulse motors 103*a* and 103*b* is controlled by a controller 129 or the like which will be described in detail later.

Between the feed roller 94 and delivery roller 101, there is provided a platen pallet 104 which has the recording paper P having been carried to the printing position face the ink-spraying surface 41 of the head 37. The platen pallet 104 also serves as a guide plate to guide the leading end of the paper P from the feed roller 94 to the delivery roller 101. It should be noted that with the paper P set in the printing position, the platen pallet 104 is located parallel and opposite to the ink-spraying surface 41 of the head 37 with a predetermined gap from the latter.

Also, on the lower housing 61*b*, there is provided a lifting mechanism (not shown) to move the aforementioned feed roller 94, delivery roller 101, platen pallet 104, etc. vertically between a carrying-ready position in which the recording paper P may be carried on these elements as shown in FIG. 11, and a parking position lower than the carrying-ready position and to which the elements are brought when the printer 1 is not in operation as shown in FIG. 10.

In the paper feed/delivery mechanism 72 constructed as above, since the recording paper P in the printing position is kept tight in the carrying direction as shown in FIG. 12, when the trailing end of the paper P carried in the direction of arrow E in FIG. 12 leaves the nip point of the feed roller 94, that is, a point where the feed roller 94 nips the paper P, a load the feed roller 94 slower in speed of rotation than the delivery roller 101 applies in a direction opposite to the carrying direction, that is, a load applied to the paper P in a direction opposite to the direction of arrow E in FIG. 12, will not act on the paper P any longer. Thus, the paper P will be carried only by the delivery roller 101 higher in speed of rotation than the feed roller 94 and hence the paper P is carried at a higher speed in the process of printing.

In the printer body 3, there is also provided the paper speed discrimination unit 73 to detect the carrying speed of the recording paper P and judge whether the paper feed/delivery mechanism 72 has changed the carrying speed of the paper P, in other words, whether the paper carrying speed has become higher.

As shown in FIG. 12, the paper speed discrimination unit 73 includes a paper trailing-end sensor 111 to detect the trailing end of the recording paper P being carried in the direction of arrow E, an encoder 112 to detect the rotation of the feed roller 94, and a controller 129 including a CPU (central processing unit) etc. that will be described in detail later.

The paper trailing-end sensor 111 is disposed upstream in the paper carrying direction in relation to the feed roller 94, more specifically, between the second limit plate 99 and feed roller 94, to detect the trailing end of the recording paper P to be carried to the printing position before the paper P goes between the feed roller 94 and press roller 100 and supplies the detected paper trailing-end detection data to the controller 129.

The encoder 112 detects the rotation of the feed roller 94 and supplies data on the detected rotation corresponding to the speed of rotation of the feed roller 94 to the controller 129.

The above paper speed discrimination unit 73 also includes a memory 128 or the like having speed discrimination data pre-stored therein and which will be described in detail later. The speed discrimination data is prepared based on a distance between the paper trailing-end sensor 111 and feed roller 94 and distance of carrying of the recording paper P by the feed roller 94 per unit time, to indicate how much the feed roller 94 should be rotated after the trailing end of the recording paper P is detected by the paper trailing-end sensor 111 and before the trailing end of the paper P arrives at the nip point and then leaves the nip point immediately after that and thus the paper carrying speed varies. Therefore, in the paper speed discrimination unit 73, the paper trailing-end sensor 111 detects the trailing end of the paper P and supplies the paper trailing-end detection data to the controller 129, and hence the controller 129 can determine, based on the paper tailing-end detection data, pre-stored speed discrimination data and detected-rotation data from the encoder 112, that the paper P leaves the nip point of the feed roller 94 and is carried at a high speed.

In the above example, the paper speed discrimination unit 73 judges, by the paper trailing-end sensor 111 and encoder 112, whether the paper carrying speed has been changed, to which however the present invention is not limited. Alternatively, a load applied to the feed roller 94 and delivery roller 101 when carrying the recording paper P may be detected directly and it be determined, when the load is found varied, that the carrying speed has been changed. Also, a load applied to the paper P kept tight by the feed roller 94 and delivery roller 101 is detected directly or indirectly and it be determined, when the load is found varied, that the carrying speed has been changed.

The temperature sensor 74 detects the ambient temperature near the head 37 when spraying the ink i, digitalizes it into an information signal and supplies it as environment data to the controller 129. The temperature sensor 74 is located downstream in the carrying direction with reference to the head 37, more specifically, near the ink-spraying surface 41 to extend along the lateral side of the head 37, as shown in FIGS. 10 and 11.

In the controller 129 which will be described in detail later, the memory 128 has pre-stored therein carrying-speed data as to moving distance of the recording paper P per unit time, which varies depending upon the ambient temperature. The controller 129 specifies, based on the carrying speed data and the environment data supplied to the controller 129 from the temperature sensor 74, a distance over which the paper P is carried per unit time at the time of printing, that is, a carrying speed at each temperature. It should be noted that the memory 128 has stored therein a plurality of carrying speed data for different types of the paper P because the nipping or gripping by the feed roller 94 and delivery roller 101 varies depending upon the type, thickness and the like of the paper P.

Note here that although there has been described, by way of example, the discrimination of the carrying speed of the paper P, made based on the environment data resulted from the detection by the temperature sensor 74 of the temperature around the head 37, the present invention is not limited to this embodiment but data on the carrying speed varying depending upon the humidity or the like of the recording paper P, for example, may be stored in the memory 128 and a carrying speed of the paper P be determined based on the environment data obtained by detecting the humidity around the head 37 by a humidity sensor or the like. Alternatively, data on the carrying speed varying depending upon the temperature and/or humidity of the paper P, for example, may be stored in the memory and a carrying speed of the paper P be determined based on the environment data obtained by detecting the humidity and temperature around the head 37 by a temperature/humidity sensor or the like.

Figure 13:
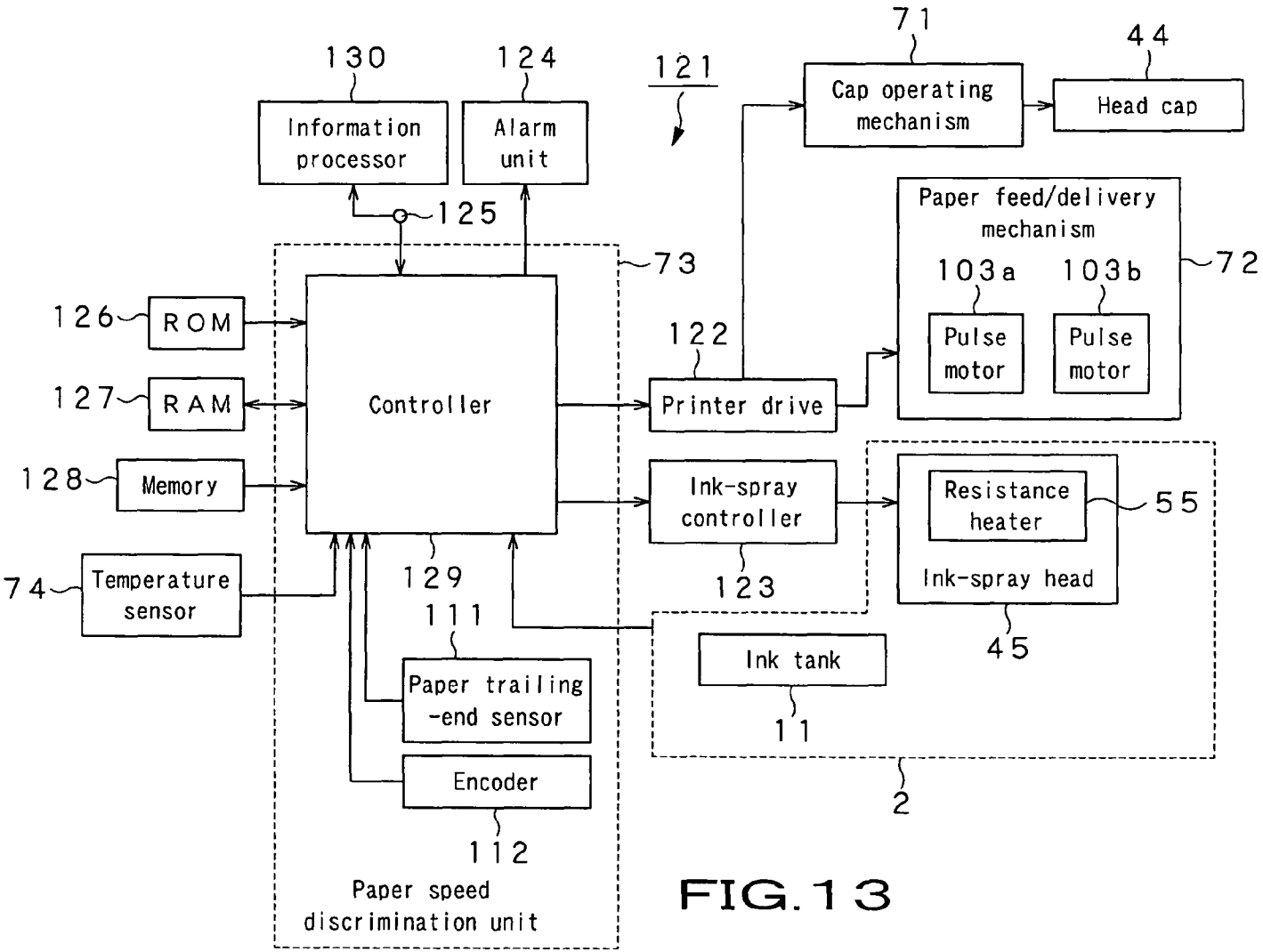
FIG. 13 is a block diagram of a control circuit in the liquid sprayer.

Referring now to FIG. 13, there is schematically illustrated a control circuit 121 which controls the printing by the printer 1 constructed as above. The control circuit 12 is as will be explained below.

The control circuit 121 includes a printer controller 122 to control the operation of the head cap opening mechanism 71 and paper feed/delivery mechanism 72 of the printer body 3, an ink-spraying controller 123 to control the current supplied to the ink-spraying head 45 for each colored ink i, an alarm unit 124 to alarm the remaining amount of each colored ink i, an input/output terminal 125 for input and output of signals from and to an external apparatus, a ROM (read-only memory) 126 having control program etc. stored therein, a RAM (random access memory) 127 for storing the control program read from the RAM 127 once and from which the control data is read as necessary, the memory 128 having stored therein ink-spraying control data intended for use to control the timing of spraying the ink i from the nozzle 52*a* correspondingly to the type of recording paper P used, and the controller 129 to control each of the other components.

The printer drive 122 drives a drive motor (not shown) included in the head cap operating mechanism 71 according to a control signal supplied from the controller 129 to control the head cap operating mechanism 71 to open and close (operate) the head cap 44. Also, the printer drive 122 drives a drive motor (not shown) included in the paper feed/delivery mechanism 72 according to a control signal supplied from the controller 129 and the pulse motors 103*a* and 103*b* to control the paper feed/delivery mechanism 72 to feed recording paper P from the paper tray 64 of the printer body 3 and deliver the printed paper P from the paper inlet/outlet 63 onto the lid tray 65.

The ink-spraying controller 123 is an electric circuit including a switching element to make/break an electrical connection with an external power source which supplies a pulse current to the resistance heater 55 included in the ink-spraying head 45, a resistive element to adjust the pulse current supplied to the resistance heater 55, a control circuit to selectively turn on and off the switching element, etc. The ink-praying controller 123 adjusts the pulse current for supply to the resistance heater 55 included in the ink-spraying head 45 according to the control signal from the controller 129 to control the timing of spraying the ink i from the nozzles 52*a* of the ink-praying head 45.

The alarm unit 124 is a displaying means such as an LCD (liquid crystal display) to display printing conditions, printed state, remaining amount of ink, etc. Alternately, the alarm unit 124 may be a voice outputting means such as speaker, for example. In this case, the alarm unit 124 outputs the printing conditions, printed state, ink remaining-amount, etc. with voice. Also, the alarm unit 124 may be a combination of such a displaying means and voice outputting means. Also, alarming may be made by a monitor or speaker of an information processor 130.

The input/output terminal 125 sends the information such as the aforementioned printing conditions, printed state, ink remaining-amount, etc. to the external information processor 130, etc. via an interface. Also, the input/output terminal 125 is supplied with a control signal intended for outputting the information such as the printing conditions, printed state and ink remaining-amount, data to be printed, etc. from the external information processor 130. The information processor 130 is for example an electronic device such as personal computer, PDA (personal digital assistant) or the like.

The input/output terminal 125 to be connected to the information processor 130 or the like may use a serial interface, parallel interface or the like, and more particularly it complies with the Standards such as USB (Universal Serial Bus), RS (recommended Standard) 232C, IEEE (Institute of Electrical and Electronic Engineers) 1394, etc. Also, the input/output terminal 125 may be designed to make data communications, in either cable or radio format, with the information processor 130. It should be noted that the applicable radio communication standards include IEEE 802.11a, 802.11b, 802.11g, etc.

Between the input/output terminal 125 and information processor 130, there may be interposed a network such as Internet. In this case, the input/output terminal 125 is connected to a network such as LAN (local area network), ISDN (integrated services digital network), xDSL (digital subscriber line), FTHP (fiber to the home), CATV (community antenna television), BS (broadcasting satellite) or the like. The data communications are done under any of various protocols such as TCP/IP (transmission control protocol/Internet protocol).

The ROM 126 is for example a memory such as EP-ROM (erasable programmable read-only memory) and has stored therein programs for operations controlled by the controller 129. A program stored in the ROM 126 is loaded to the RAM 127 under the control of the controller 129.

The RAM 127 stores a program read from the ROM 126 under the control of the controller 129, paper trailing-end detection data and rotation detection data supplied to the controller 129 from the paper trailing-end sensor 111 and encoder 112 in the speed discrimination unit 73, and environment data supplied to the controller 129 from the temperature sensor 74.

The memory 128 is for example a ROM, EP-ROM or RAM. It has stored therein the aforementioned speed discrimination data, carrying speed data for each type of the recording paper P, etc. Also, the memory 128 has stored therein, in addition to the above data, the ink-spraying control data for each type of the recording paper P.

The ink-spraying control data is program data used by the ink-spraying controller 123 to control the ink-spraying head 45 to adjust the ink-spraying timing for correction of color mis-registration in a direction opposite to the paper carrying direction, if any caused by the displacement of the ink i-projected position in the carrying direction, for an increment of the carrying speed of the recording paper P increased in the process of printing as in the conventional inkjet printing.

The above will be explained in further detail below with reference to FIGS. 14A to 14C. It should be noted that in FIGS. 14A to 14C, of the colors of ink i projected on the recording paper P, yellow is indicated with "y", magenta is with "m", cyan is with "c" and black is with "k".

Figure 14A:
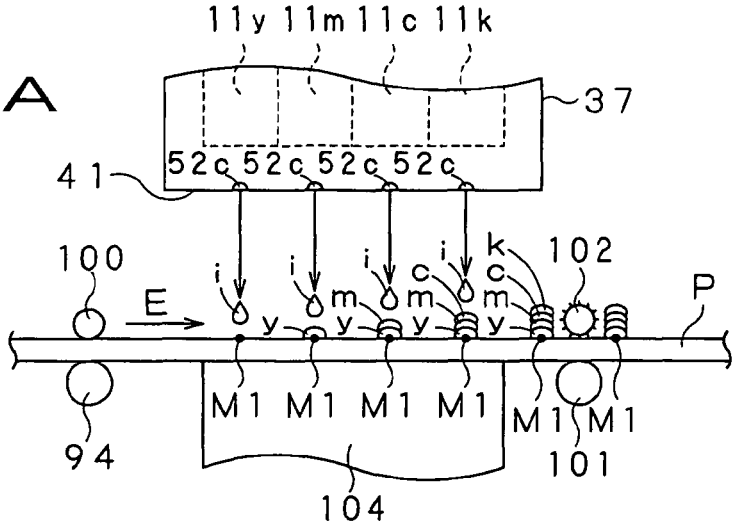
FIGS. 14A to 14C explain ink-praying control data for correcting color mis-registration caused when the paper-carrying speed is increased in the process of printing in the liquid sprayer, in FIG. 14A shows ink being sprayed onto the recording paper being carried, FIG. 14B explains color mis-registration caused when the paper-carrying speed is increased in the process of printing, and FIG. 14C explains how to correct the color mis-registration.
Figure 14B:
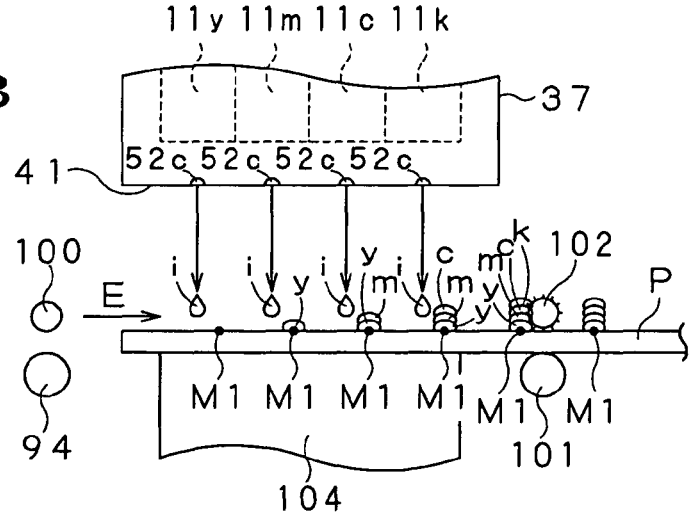
Figure 14C:
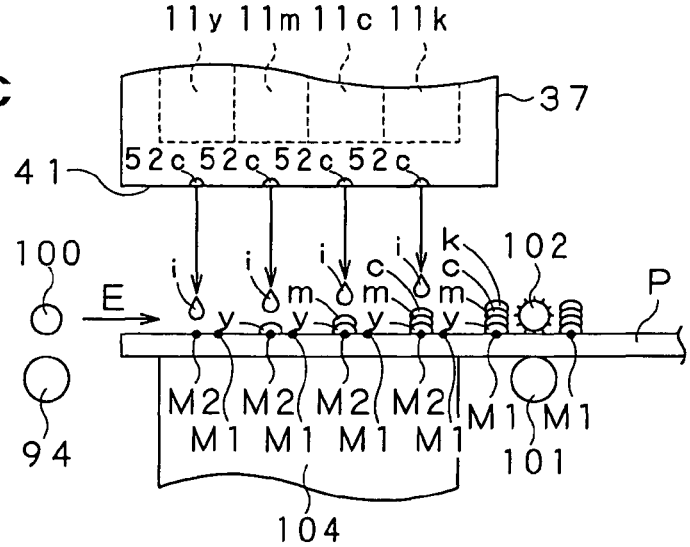

For printing on the recording paper P, the nozzles 52*a* provided on the ink-spraying surfaces 41 corresponding to the ink tanks 11*y*, 11*m*, 11*c* and 11*k* arrayed on the ink-spraying surface 41 orderly in the carrying direction of the paper P as shown in FIG. 14A, that is, in the direction of arrow E in FIG. 14A, spray and project yellow, magenta, cyan and black ink i in this order to predetermined ink-projected positions M1 on the paper P. If the carrying speed of the paper P is changed because the trailing end of the paper P leaves the nip point of the feed roller 94 in the process of printing, for example, the ink-projected positions will be displaced upstream in the carrying direction of the paper P from the predetermined ink-projected position M1 because the head 37 sprays the ink i sequentially from each nozzle 52*a* in predetermined timing, as will be seen in FIG. 14B. That is, color mis-registration occurs. The ink-spraying control data stored in the memory 128 is intended to have the ink-spraying controller 123 control the timing of spraying the ink from each nozzle 52*a* in order to correct the color mis-registration. Namely, as shown in FIG. 14C, the timing of spraying the ink i from the nozzle 52*a* other than the nozzle 52*a* for the black ink i is controlled for the ink i other than the black ink i to be projected to a nearly same position as a position M2 displaced upstream in the carrying direction of the paper P and to which the black ink i is to be projected. More specifically, the timing of spraying the other ink i than the black ink i, which is sprayed before the black ink i, is so controlled to be delayed in relation to that which is before the carrying speed of the paper P has been increased that the other ink i than the black ink i will be projected to the position M2 to which the black ink i is to be projected.

Figure 15:
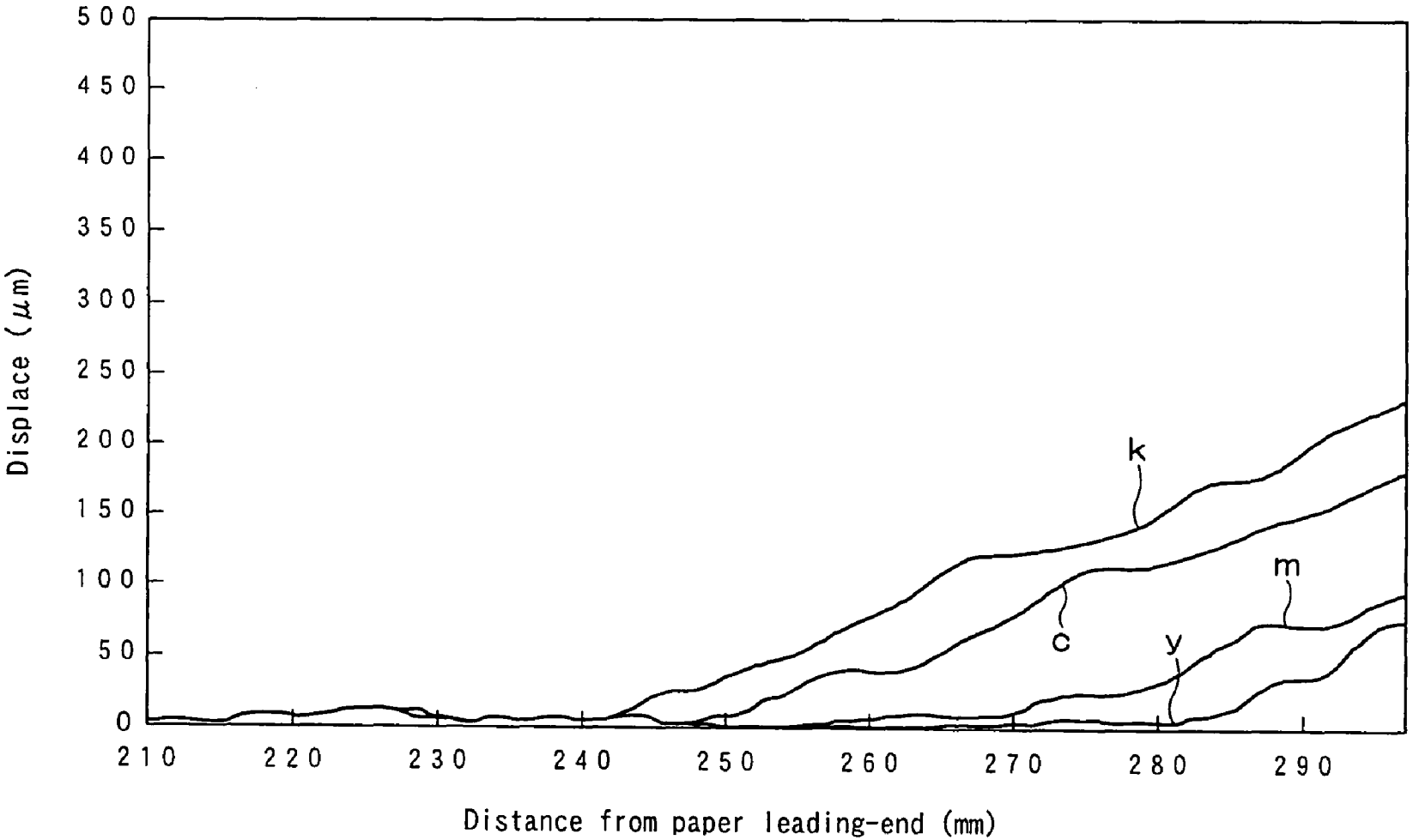
FIG. 15 shows mis-registration between colored ink-projected positions, caused when the paper-carrying speed is increased.

FIG. 15 shows the results of measurement, at various distances from the leading end of the recording paper P, of the displacement, from the normal ink-projected position M1, of a position to which the ink inks projected when the paper carrying speed is increased in the process of printing, namely, the results of measurement of displacement between the ink-projected positions M1 and M2. It should be noted that "y" in FIG. 15 indicates a displacement of the projected position of yellow ink i, "m" indicates a displacement of the projected position of magenta ink i, "c" indicates a displace of the projected position of cyan ink i and "k" indicates a displacement of the projected position of the black ink i.

As seen from the results of measurement shown in FIG. 15, the carrying speed starts being changed and also the color mis-registration starts taking place when the printing has proceeded about 250 mm from the leading end of the recording paper P, and the mis-registration of the black ink i sprayed from the nozzle 52*a* located most downstream in the carrying direction of the paper P will be largest. The ink-spraying control data is to correct the color mis-registration by spraying the other ink i than the black ink i in timing delayed in relation to that which is before the carrying speed is increased so that the mis-registration of the other ink i than the black ink i will be nearly the same as that of the black ink i as shown in FIG. 15.

After the color mis-registration taking place due to the change in carrying speed is corrected, the color mis-registration will take place with the other ink i than the black ink j being sprayed in delayed timing. So, the ink-spraying control data is used to have the ink-spraying controller 123 control the ink-spraying timing for each colored ink i to be sprayed from the corresponding nozzle 52*a* in timing delayed in relation to that which is before the carrying speed is changed.

Generally in the printer 1, when the ambient temperature and humidity are high, the endless drive belt connecting the aforementioned feed roller 94 and delivery roller 101 to pulse motors 103*a* and 103*b*, respectively, will accordingly be elongated and have the pitch thereof increased. Thus, the tension of the endless drive belt is decreased and the feed pitch per tooth of the pulleys of the feed roller 94 and delivery roller 101 on which the endless drive belt is wound will be decreased, the recording paper P is carried at a lower speed and hence the color mis-registration will be smaller. That is, when the temperature and humidity are high, the displacement of the projected positions of different colored ink i will be smaller than the color mis-registration caused due to a change in carrying speed at normal temperature.

On the other hand, when the temperature and humidity are low, the endless drive belt will accordingly be reduced in length and thus have the pitch thereof decreased. Thus, the tension of the endless drive belt is increased, the feed pitch per tooth of the pulleys of the feed roller 94 and delivery roller 101 is increased, and the recording paper P is carried at a higher speed, resulting in a larger color mis-registration. That is, when the temperature and humidity are low, the displacement of the projected positions of different colored ink i will be larger than the color mis-registration caused due to a change in carrying speed at normal temperature.

Therefore, to correct color mis-registration according to the ink-spraying control data, the controller 129 adjusts the ink-spraying control data on the basis of the environment data obtained by means of the temperature sensor 74 and has the nozzles spray the other ink i than the black ink i in timing controlled according to the ink-spraying control data to project the other ink i than the black ink i to the position M2 to which the black ink i is to be projected.

The memory 128 having stored therein the ink-spraying control data used by the ink-spraying controller 123 to control the ink spraying has also stored therein a plurality of kinds of ink-spraying control data for different types of the recording paper P because the nipping or gripping of the feed roller 94 and delivery roller 101 vary depending upon the type, thickness, etc. of the paper P so that the carrying speed varies to different extents, that is, because the color mis-registration varies in extent from one type to another of the paper P.

The controller 129 is for example a CPU, and controls the other components of the printer 1 according to to-be-printed data supplied at the input/output terminal 125 and data on the remaining amount of the ink i, supplied from the head cartridge 2. The controller 129 reads, from the ROM 126, the processing programs for controlling the components according to the supplied control signal etc., stores the program into the RAM 127, and controls the components according to the respective processing programs.

That is, the controller 129 controls, according to the processing program stored in the ROM 166, the head cap operating mechanism 71 to open or close the head cap 44, and the paper feed/delivery mechanism 72 to feed recording paper P from the paper tray 64 and deliver printed paper P onto the lid tray 65 in the paper inlet/outlet 63. Also, before the carrying speed is increased, the controller 129 controls the ink-spraying controller 123 according to the environment data from the temperature sensor 74 and carrying speed data pre-stored in the memory 128 to spray ink i appropriately in predetermined timing. After the carrying speed is increased in the process of printing, the controller 129 controls the ink-spraying controller 123 according to the environment data and ink-spraying control data pre-stored in the memory 128 to make a print free from color mis-registration on the paper P.

Note that although the processing program is stored in the ROM 126 in the control circuit 121 constructed as above, the present invention is not limited to this data storage into the ROM 126 but the processing data may be stored for example in any other recording medium such as optical disk, magnetic disk, magneto-optical disk, IC card or the like. In this case, the control circuit 121 is connected directly or via the information processor 130 to a drive that drives such a recording medium to read the processing program from the recording medium.

Also, although speed discrimination data, carrying speed data, a plurality of ink-spraying control data, etc. are stored in the memory 128 in the above embodiment, these data may be stored in the RAM 127 and/or ROM 126, for example, if the capacity of the latter device is sufficient for such storage.

Figure 16:
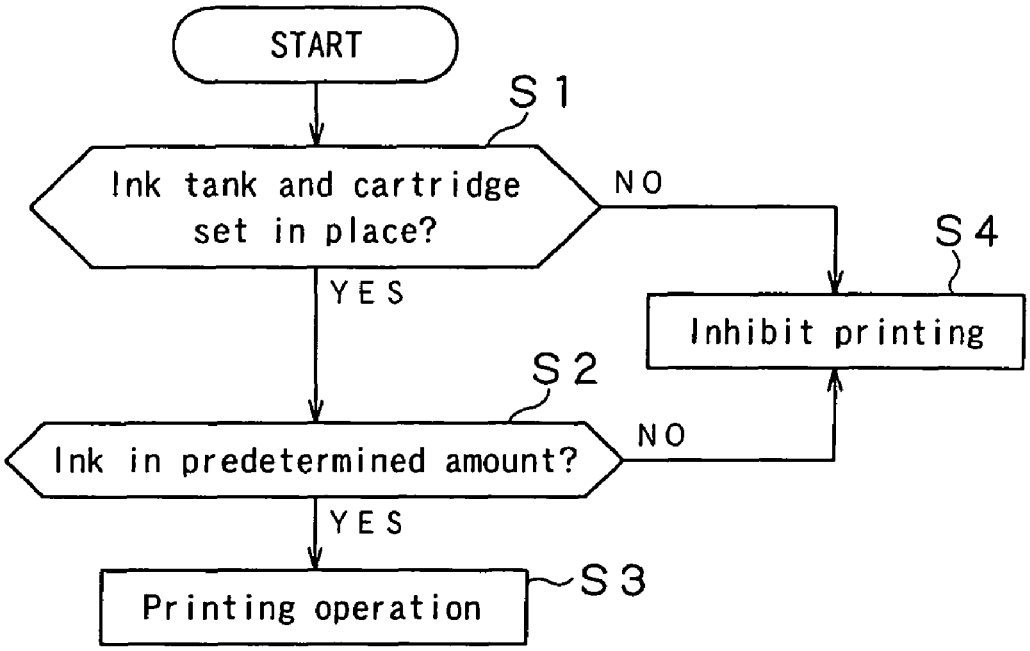
FIG. 16 shows a flow of operations made in printing preparation in the printer.

Now, the printing operation of the printer 1 constructed as above will be described with reference to the flow diagrams in FIGS. 16 and 17. It should be noted that the printing will be done under the control of the CPU (not shown) in the controller 129 according to the processing program stored in the storage means such as the ROM 126 or the like.

For printing by the printer 1, the user first operates the control buttons 68 provided on the printer body 3 or enters a print command, which is to be followed by the printer 1, from the external information processor 130 to the controller 129 via the input/output terminal 125. At this time, information signal as to the type of a sheet of recording paper P going to be used is also supplied to the controller 129 to set the type of paper P for printing.

Next, the controller 129 judges in step S1 whether ink tanks 11 for predetermined colors are set in place in the tank receptacle 31 and whether the head cartridge 2 is set in place in the head receptacle 66 of the printer body 3. When having determined that the ink tanks 11 for the predetermined colors are correctly set in the tank receptacle 31 and the head cartridge 2 is set in the head receptacle 66 of the printer body 3, the controller 129 goes to step S2. On the contrary, when the ink tanks 11 are not correctly set in the tank receptacle 31 and/or the head cartridge 2 is not correctly set in the head receptacle 66 of the printer body 3, the controller 129 goes to step S4 where it will inhibit any more printing operation.

In step S2, the controller 129 judges whether the ink tank 11 contains the ink i in a smaller amount than predetermined or no ink i. When having determined that the ink tank 11 contains no ink i, the controller 129 has the alarm unit 124 issue an alarm and goes to step S4 where it will inhibit any more printing operation. On the contrary, when the ink tank 11 contains a larger amount of the ink i than predetermined, namely, when it is filled with a sufficient amount of the ink i, the controller 129 will go to step S3 where it will allow the printing operation.

Figure 17:
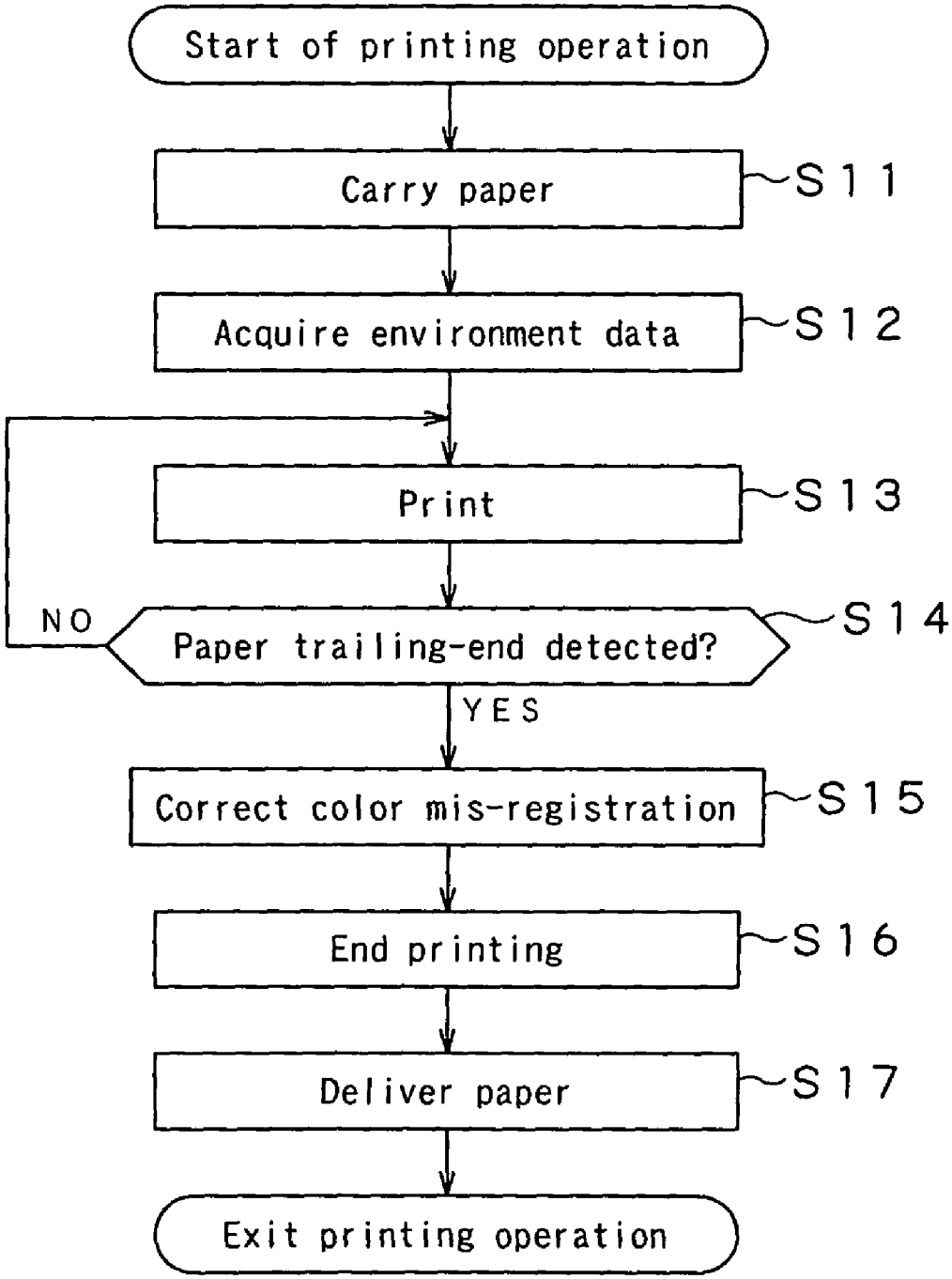
FIG. 17 shows also a flow of operations made in printing in the printer.

In the printer 1 thus allowed to print, the controller 129 controls the printer drive 122 to drive the head cap operating mechanism 71 and paper feed/delivery mechanism 72 in step S11 as shown in the flow diagram in FIG. 17, to carry the recording paper P to a position where printing can be done.

More specifically, when the printing operation is started, the controller 129 drives the head cap operating mechanism 71 to move the head cap 44 whose ink-spraying surface 41 is being closed to the parking position at the front side of the printer 1 as shown in FIG. 11. Also, the controller 129 drives the lifting mechanism (not shown) to move up the feed roller 94, delivery roller 101 and platen pallet 104 from the parking position to the carrying-ready position as shown in FIG. 11, and puts the pulse motors 103*a* and 103*b* into operation to carry the recording paper P in the direction of arrow E in FIG. 11. At this time, the temperature sensor 74 detects, in step S12, a temperature near the head 37 and supplies it as environment data to the controller 129.

Next in step S13, the controller 129 controls the ink-praying head 45 by means of the ink-spraying controller 123 according to the environment data supplied from the temperature sensor 74 and carrying speed data for the type of paper P, pre-stored in the memory 128 and set at the start of printing to control the ink-spraying head 45, to spray and project the ink i in appropriate timing onto the paper P having been carried by the paper feed/delivery mechanism 72 to the printing position and kept tight in the carrying direction by the feed and delivery rollers 94 and 101, thereby to form characters and graphics from ink dots according to data to be printed such as character, graphic data, etc. supplied from the external information processor 130 via the input/output terminal 125, namely, to print the paper P.

Then in step S14, the paper trailing-end sensor 111 of the paper speed discrimination unit 73 detects the trailing end of the recording paper P being printed, and the paper trailing-end, if detected, is supplied as paper trailing-end detection data to the controller 129 from the paper speed discrimination unit 73. The printing in step S13 is continuously done until the trailing end of the paper P is detected, and when the trailing end of paper P is detected, the controller 129 determines, based on the paper trailing-end detection data from the paper trailing-end sensor 111, rotation speed data from the encoder 112 and speed discrimination data pre-stored in the memory 128, that the carrying speed of the paper P has been increased. Then the controller 129 goes to step S15 where it will correct color mis-registration.

Next, when the trailing end of the recording paper P has been detected and the paper speed discrimination unit 73 determines that the carrying speed of the recording paper P has been increased, the controller 129 controls, in step S15, the ink-spraying head 45 by means of the ink-spraying controller 123 according to the environment data supplied from the temperature sensor 74 and ink-spraying control data pre-stored in the memory 128, for the type of paper P, and set at the start of printing, to spray the other ink i than the black ink i in timing delayed in relation to that which is before the carrying speed is increased, thereby correcting the position where the ink i is projected for no color mis-registration to occur.

Then, after correction of the ink-projected position, the controller 129 controls the ink-spraying controller 123 according to the ink-spraying control data to spray the ink i in each color sequentially in the ink-spraying timing which is before the paper carrying speed is changed, make printing of the data to be printed to the last character or graphic and then terminate the printing as in step S16.

Next in step S17, the controller 129 controls the paper feed/delivery mechanism 72 to deliver the printed recording paper P onto the lid tray 65 from the delivery roller 101, and exits the printing operation.

Then, in the printer 1, the printing operations in steps S11 to S117 are repeatedly done until the ink i in the ink tank 11 runs short, no more recording papers P remain in the paper tray 64 or a command for sopping the printing is supplied from the control buttons 68 or from the external information processor 130 via the input/output terminal 125.

In the printer 1 that prints as above, when the trailing end of the recording paper P being printed is detected by the paper trailing-end sensor 111 of the paper speed discrimination unit 73 and it is determined that the carrying speed of the paper P has been increased, color mis-registration caused by the change of the carrying speed is corrected according to the environment data from the temperature sensor 74 and ink-spraying control data pre-stored in the memory 128 for the type of the paper P.

That is, in the printer 1, when the carrying speed of the recording paper P is increased in the process of printing, the timing of spraying the other ink i than the black ink sprayed from the nozzle 52*a* located most downstream in the carrying direction is delayed in relation to that which is before the carrying speed of the paper P is increased to project the other ink i than the black ink i to the position to which the black ink i is to be projected, to thereby correct color mis-registration which is caused when the paper carrying speed has been increased.

Therefore, in this printer 1, even if the paper carrying speed is changed in the process of printing, quality printing can be done with prevention of color mis-registration caused when the paper carrying speed is changed in the process of printing because the ink-spraying timing is controlled according to the type of the recording paper P, ambient temperature, etc.

Next, the second embodiment of the present invention will be illustrated and explained. It should be noted that the same elements of the second embodiment as those in the first embodiment will be indicated with the same reference numerals as those used in the illustrated and explanation of the first embodiment and will not be described in detail.

Figure 18:
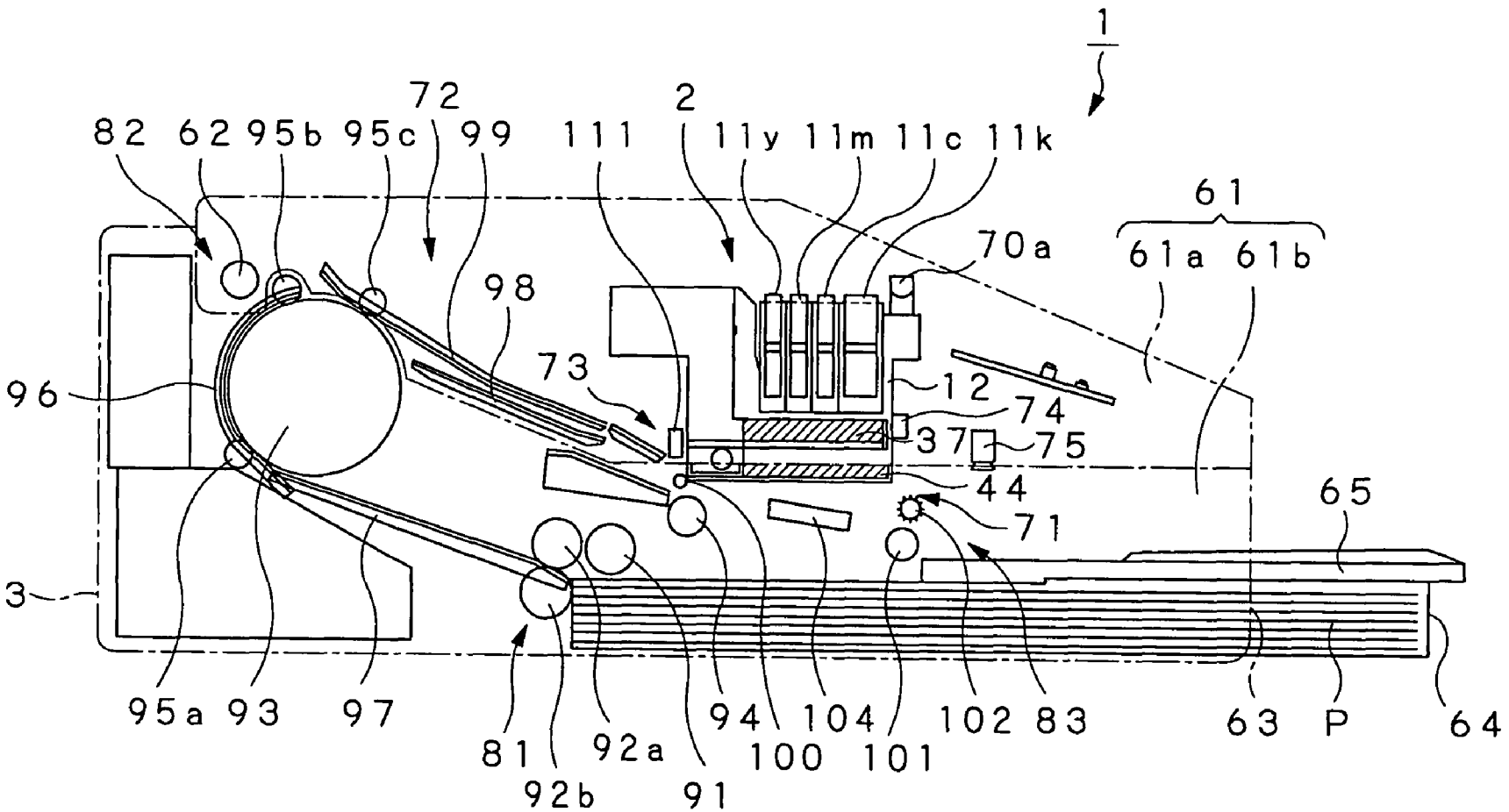
FIG. 18 is a side elevation of a printer according to the second embodiment of the present invention.
Figure 19:
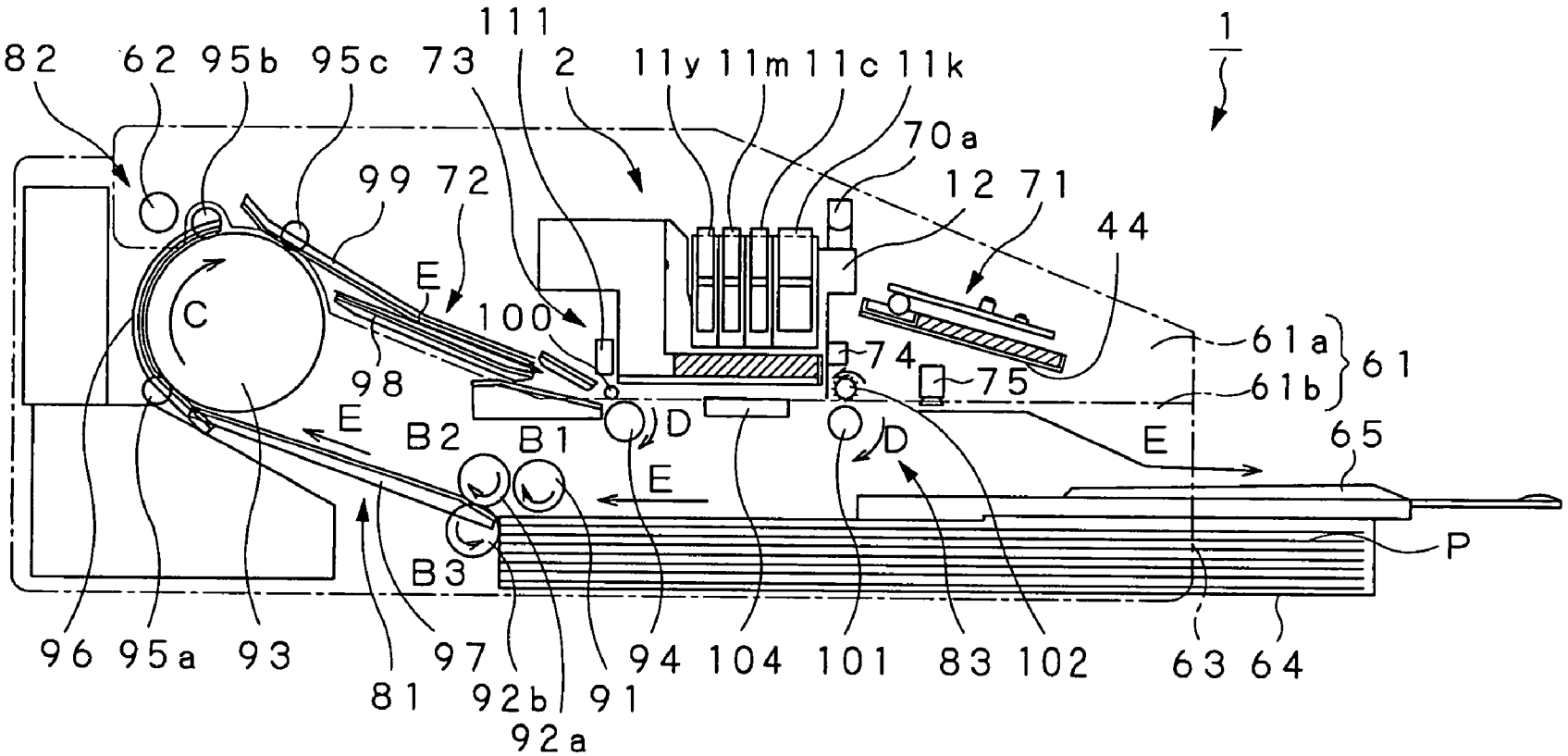
FIG. 19 is also a side elevation explaining the printing operation of the printer in FIG. 18.

As shown in FIGS. 18 and 19, the second embodiment of the present invention further includes an ink-projected position detector 75 that detects a position to which ink i is projected on a test pattern printed prior to forming predetermined characters and graphics by printing.

Figure 20:
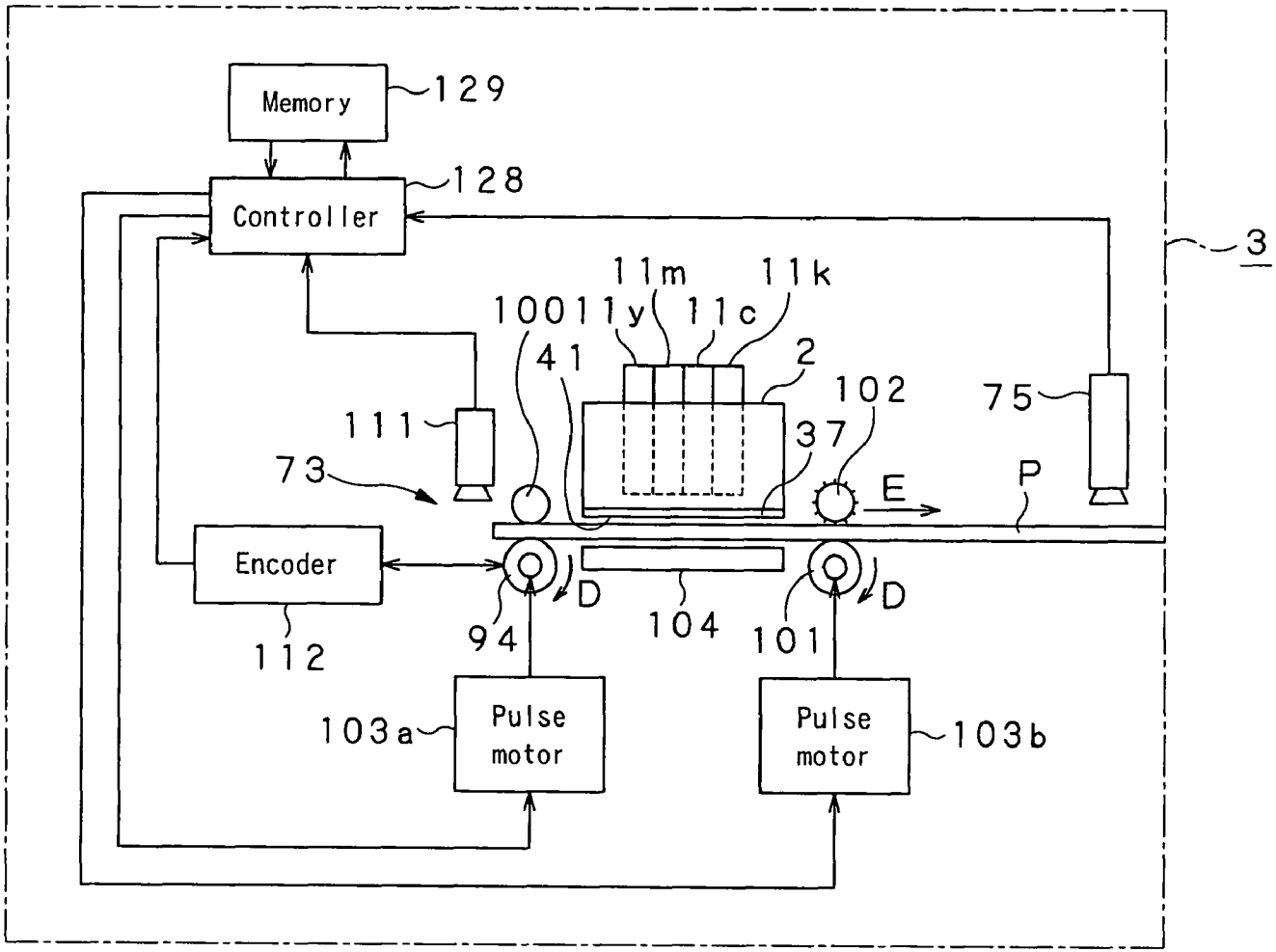
FIG. 20 explains rollers for keeping the recording paper tight in the paper feed/delivery mechanism of the printer in FIG. 18.

The ink-projected position detector 75 is located downstream in the carrying direction in relation to the delivery roller 101. It includes a reflection photosensor, charge-coupled device (CCD) image sensor, etc. to detect an ink i-projected position on a predetermined test pattern printed by projecting the ink i onto the recording paper P prior to printing predetermined characters and graphics. The ink-projected position detector 75 detects a displacement of the ink i-projected position which will possibly be caused when the carrying speed is changed, digitalizes the detected displacement into information signal, and supplies the signal as ink-projected position data to the controller 129 (also see FIG. 20).

Figure 21:
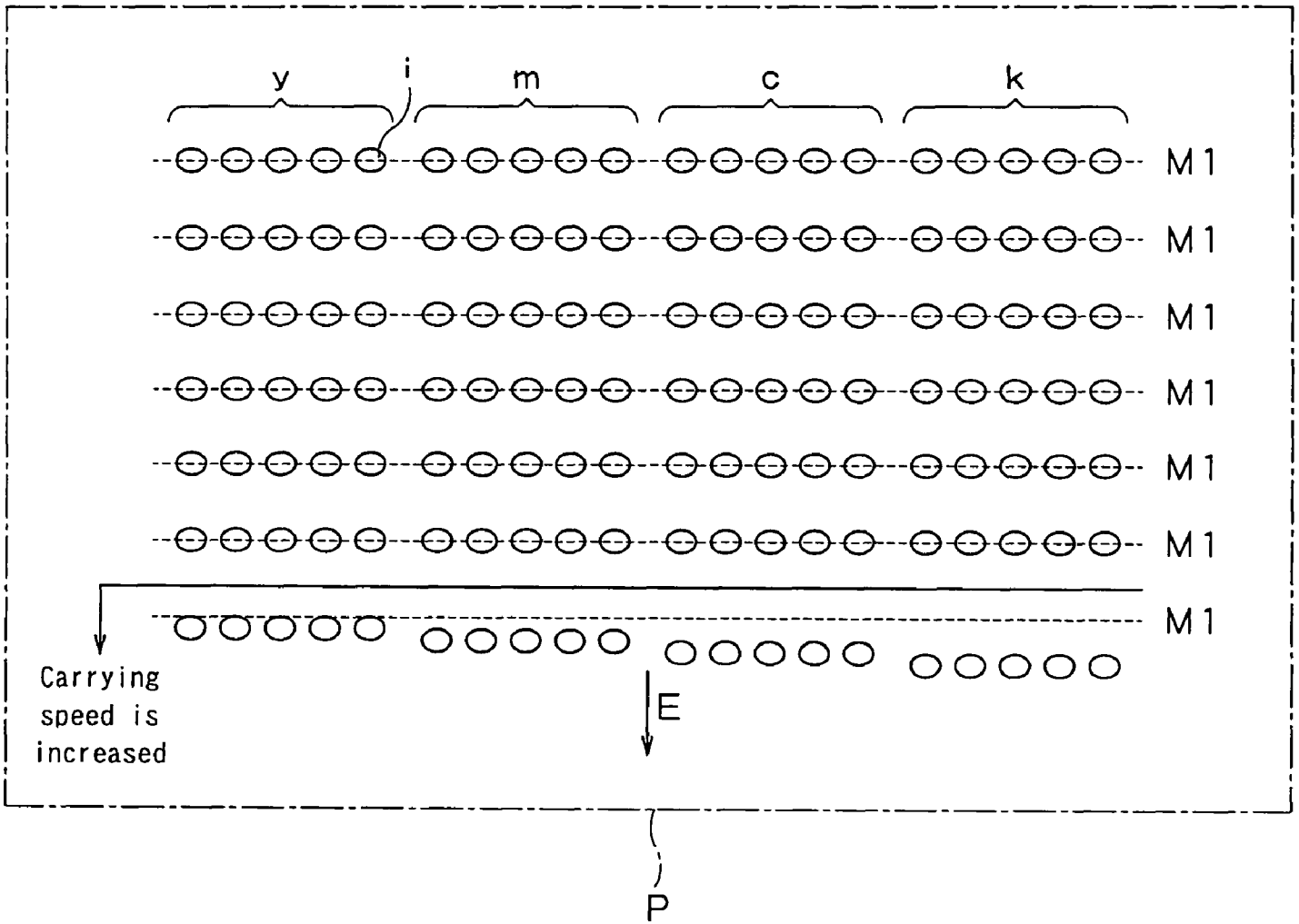
FIG. 21 shows an example of the test pattern used for detecting an ink-projected position by an ink-projected position detector of the printer in FIG. 18.

The test pattern on which the ink-projected position detector 75 detects an ink i-projected position is a pattern formed from ink i in different colors projected at predetermined intervals of ink-spraying timing, for example, across the width of the recording paper P of the same type as that on which predetermined characters and graphics are to be printed, as shown in FIG. 21. The ink-projected position detector 75 detects an ink i-projected position on the test pattern, checks how much the position to which the ink has been projected after the carrying speed of the paper P is changed, namely, after the speed is increased, is off the ink-projected position M1 to which the ink would normally be projected if the carrying speed were not changed, and supplies ink-projected position control data corresponding to the type of the paper P used for the detection to the controller 129. It should be noted that in FIG. 21, of the colors of ink i projected on the recording paper P, yellow is indicated with "y", magenta is with "m", cyan is with "c" and black is with "k".

Next, a control circuit 131 to control the printer 1 according to the second embodiment will be described with reference to FIG. 22. The control circuit 131 corresponds to the control circuit 121 included in the first embodiment having been described in the foregoing.

The above control circuit 131 includes the head cap operating mechanism 71 of the printer body 3, printer drive 122 to drive the paper feed/delivery mechanism 72, ink-spraying controller 123 to control the current or the like supplied to the ink-spraying head 45 for each colored ink i, alarm unit 124 to alarm the remaining amount of each colored ink i, input/output terminal 125 to make input and output of signals from and to the external apparatus, ROM (read-only memory) 126 having control program etc. recorded therein, RAM (random access memory) 127 to store the control program read from the ROM 126 once and from which the control data is read as necessary, controller 129 to control the other components of the printer 1 and generate, for each type of the recorder paper P, ink-spraying control data intended for use to control the timing of spraying the ink i from the nozzle 52*a* according to the ink-projected position control data supplied from the ink-projected position detector 75 and corresponding to the type of the paper P used, and the memory 128 to store the ink-spraying control data generated by the controller 129.

The printer drive 122, ink-spraying controller 123, alarm unit 124, etc. operate similarly to those corresponding elements in the aforementioned first embodiment and thus their operations will not be explained in detail.

As shown in FIG. 18, the ink-projected position detector 75 is located downstream in the carrying direction in relation to the delivery roller 101, and includes a reflection photosensor, charge-coupled device (CCD) image sensor, etc. to detect an ink i-projected position on a predetermined test pattern printed by projecting the ink i on the recording paper P prior to forming predetermined characters and graphics by printing, detects a displacement of the ink i-projected position which will possibly be caused when the carrying speed is changed, digitalizes the detected displacement into information signal, and supplies the signal as ink-projected position data to the controller 129 that will be described in detail later.

The test pattern on which the ink-projected position detector 75 detects an ink i-projected position is a pattern formed from ink i in different colors projected at predetermined intervals of ink-spraying timing, for example, across the width of the recording paper P of the same type as the paper P on which predetermined characters and graphics are to be formed, as shown in FIG. 21. The ink-projected position detector 75 detects an ink i-projected position on the test pattern, checks how much the position to which the ink has been projected after the carrying speed of the paper P is changed, namely, after the speed is increased, is off the ink-projected position M1 to which the ink would normally be projected if the carrying speed were not changed, and supplies ink-projected position control data corresponding to the type of the paper P used for the detection to the controller 129.

Figure 22:
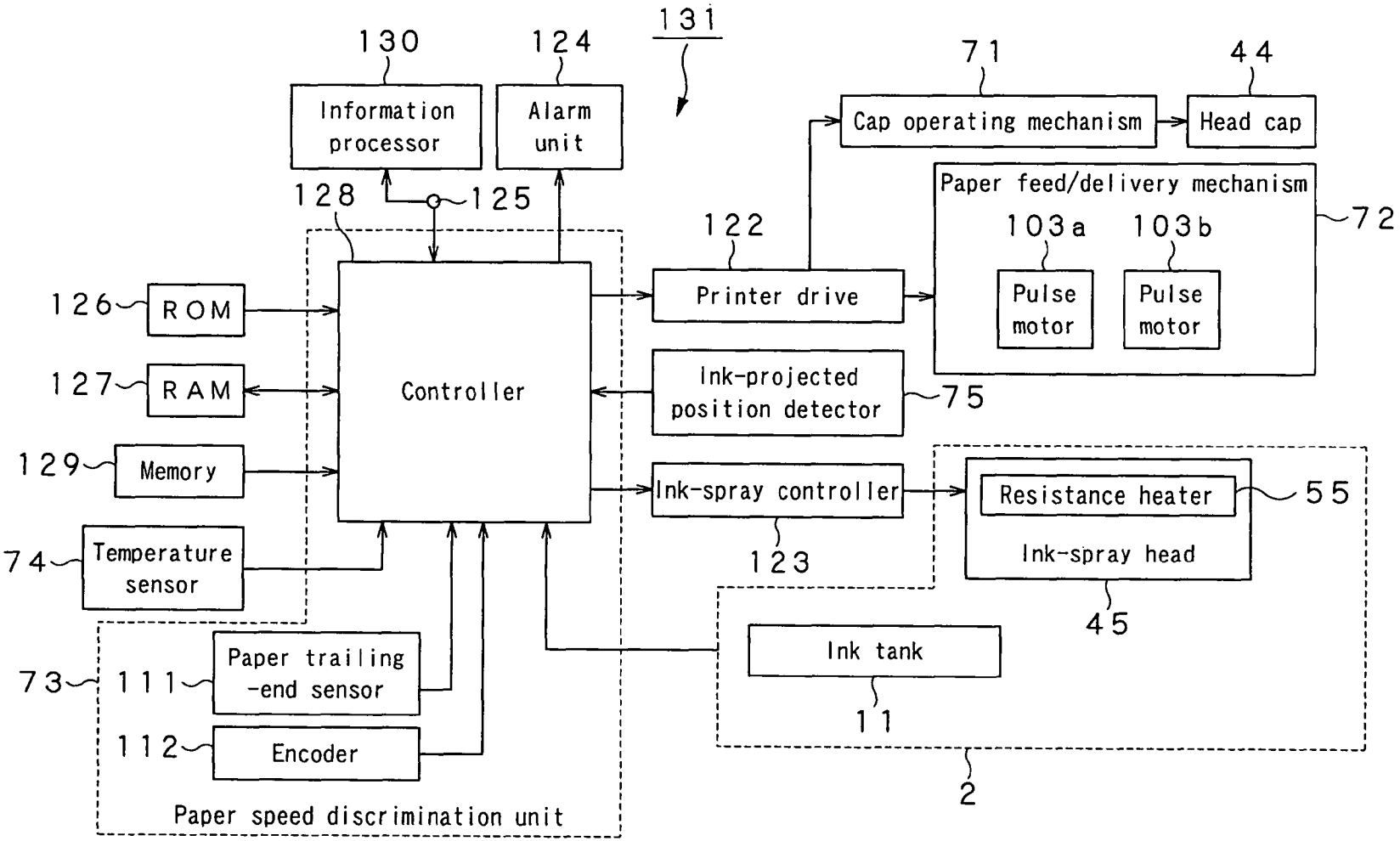
FIG. 22 is a schematic block diagram of a control circuit in the printer in FIG. 18.

Referring now to FIG. 22, there is schematically illustrated the control circuit 131 which controls the printing by the printer 1 constructed as above. The control circuit 131 will be explained below.

The above control circuit 131 includes the head cap operating mechanism 71 of the aforementioned printer body 3, printer drive 122 to drive the paper feed/delivery mechanism 72, ink-spraying controller 123 to control the current or the like supplied to the ink-spraying head 45 for each colored ink i, alarm unit 124 to alarm the remaining amount of each colored ink i, input/output terminal 125 to make input and output of signals from and to the external apparatus, ROM (read-only memory) 126 having control program etc. recorded therein, RAM (random access memory) 127 to store the control program read from the ROM 126 once and from which the control data is read as necessary, controller 129 to control the other components of the printer 1 and generate, for each type of the recorder paper P, ink-spraying control data intended for use to control the timing of spraying the ink i from the nozzle 52*a* according to the ink-projected position control data supplied from the ink-projected position detector 75 and corresponding to the type of the paper P used, and the memory 128 to store the ink-spraying control data generated by the controller 129.

Also, for each type of the recording paper P, the controller 129 generates, based on the ink-projected position data corresponding to the type of the paper P and used for detection by the ink-projected position detector 75, ink-spraying control data intended for use to adjust the ink-spraying timing for correcting color mis-registration resulted from a displacement of the ink i-projected position, caused in a direction opposite to the paper carrying direction by an increment of the paper-P carrying speed increased in the process of printing as in the conventional printer and control the ink-spraying controller 123, and stores the data into the memory 128 which will be described in detail later. Then, when the carrying speed is increased in the process of printing, the controller 129 controls the ink-spraying controller 123 according to the environment data from the temperature sensor and ink-spraying control data for the type of the paper P used for a print free from color mis-registration to be made on the paper P.

The ink-spraying control data will specifically be described below with reference to FIGS. 23A to 23C. It should be noted that in FIGS. 23A to 23C, of the colors of ink i projected on the recording paper P, yellow is indicated with "y", magenta is with "m", cyan is with "c" and black is with "k".

Figure 23A:
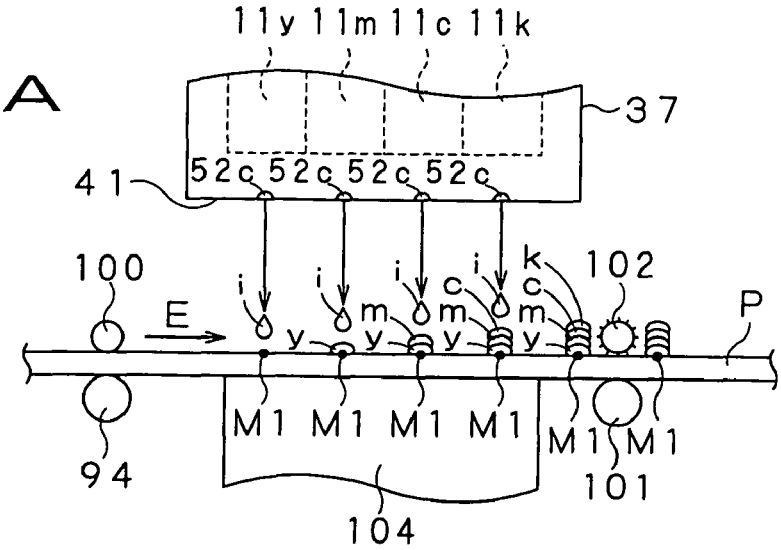
FIGS. 23A to 23C explain ink-praying control data for correcting color mis-registration caused when the carrying speed of the recording paper is increased in the process of printing in the liquid sprayer, in FIG. 23A shows ink being sprayed onto the paper being carried, FIG. 23B explains color mis-registration caused when the paper-carrying speed is increased in the process of printing, and FIG. 23C explains how to correct the color mis-registration.
Figure 23B:
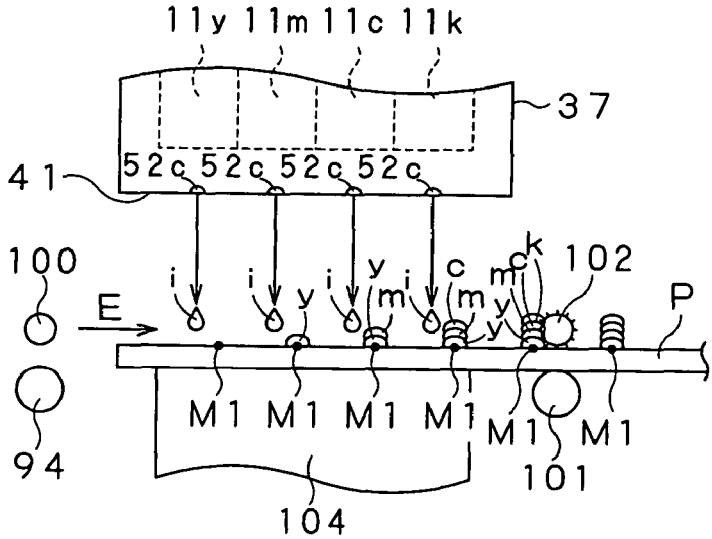
Figure 23C:
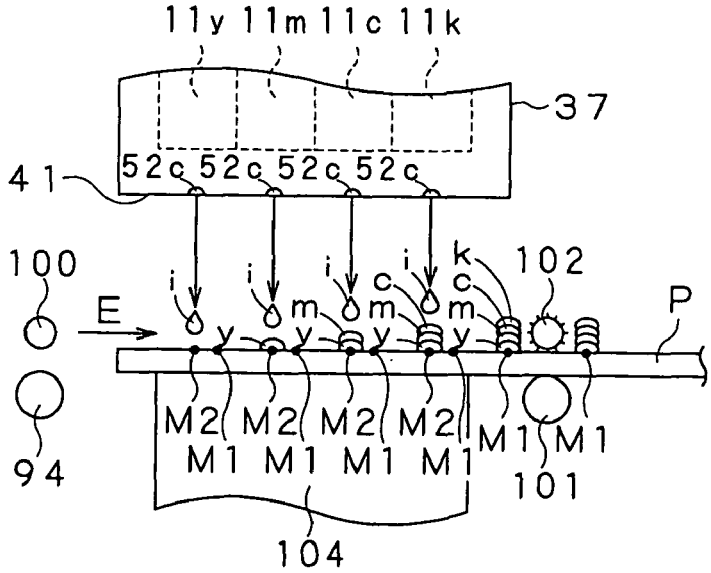

In printing the recording paper P, yellow ink i, magenta ink i, cyan ink i and black ink i sprayed from the nozzles 52*a* provided on the ink-spraying surface 41 and corresponding to the ink tanks 11*y*, 11*m*, 11*c* and 11*k* arrayed in this order in the direction of the carrying direction of the paper P, that is, in the direction of arrow E in FIG. 23A are projected in the order of yellow, magenta, cyan and black to predetermined ink-projected positions M1, respectively, as shown in FIG. 23A. If the carrying speed of the paper P is changed when the trailing end of the paper P leaves the nip point of the feed roller 94, for example, in the process of printing, each ink i is projected with a displacement from the predetermined ink-projected position M1 upstream in the carrying direction of the paper P, resulting in color mis-registration, because the head 37 sprays each ink i sequentially from each nozzle 52*a* in predetermining timing as shown in FIG. 23B The ink-spraying control data generated by the controller 129 on the basis of the ink-projected position data for the type of the paper P supplied from the ink-projected position detector 75 is supplied to the ink-spraying controller 123 which will thus be made to correct the timing of spraying the ink i from each nozzle 52*a* according to the type of the paper P in order to correct the color mis-registration. That is, according to the ink-spraying control data, the timing of spraying the ink i from the other nozzle 52*a* than that for the black ink i is controlled for the type of the paper P used so that the other ink i than the black ink i will be projected to a generally same position as an ink-projected position M2 to which the black ink i is projected being displaced upstream in the carrying direction of the paper P as shown in FIG. 23C. More specifically, the timing of spraying the other ink i than the black ink i, sprayed before the black ink i, is delayed in relation to the ink-spraying timing before the carrying speed of the paper P is increased so that the other ink i than the black ink i will be projected to the ink-projected position M2 to which the black ink i is to be projected.

Figure 24:
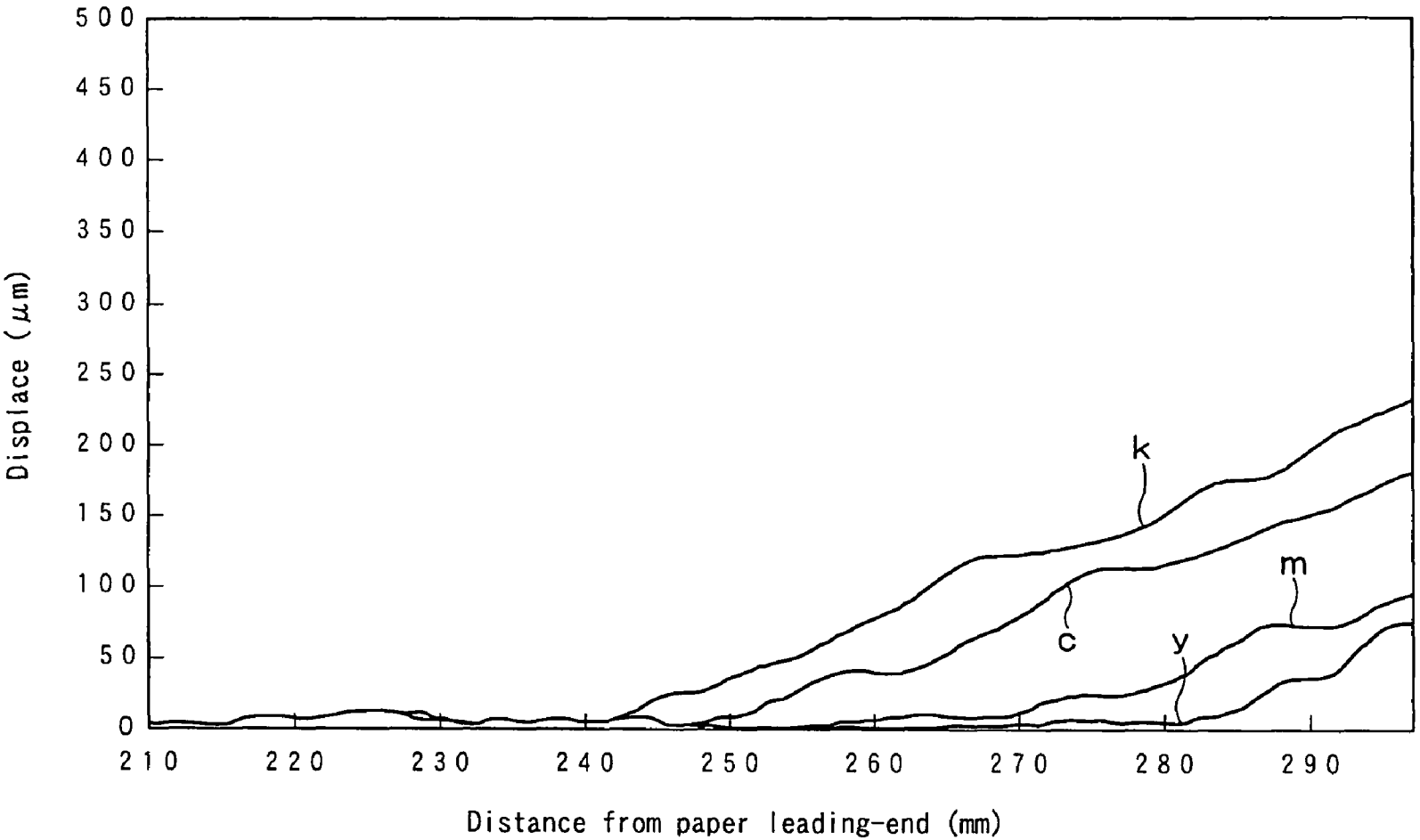
FIG. 24 shows a displacement between positions to which colored ink is projected, caused when the recording paper-carrying speed is increased.

FIG. 24 shows the results of measurement of a displacement of the projected ink i from the normal ink-projected position M1 at each distance from the leading end of the recording paper P when the carrying speed is increased in the process of printing, that is, a distance between the ink-projected positions M1 and M2. It should be noted that in FIG. 24, "y" indicates a displacement of the yellow ink i, "m" indicates a displacement of the magenta ink i, "c" indicates a displacement of the cyan ink i, and "k" indicates a displacement of the black ink i.

As will be seen from the results of measurement shown in FIG. 24, when the printing proceeds over about 250 mm from the leading end of the recording paper P, the carrying speed is changed and the color mis-registration starts taking place and the mis-registration of the black ink i sprayed from the nozzle 52*a* most downstream in the carrying direction of the paper P is largest. The aforementioned ink-spraying control data is used to prevent the color mis-registration by spraying the other ink i than the black ink i in timing delayed in relation to that which is before the carrying speed is increased so that the displacement of the projected other ink i than the black ink i will be generally the same as that of the projected black ink i as shown in FIG. 24.

After the color mis-registration due to the change of the paper carrying speed is corrected as above, keeping the timing of spraying the other ink i delayed in relation to that of spraying the black ink i will cause color mis-registration. To prevent this color mis-registration, the ink-spraying control data is used to control the ink-spraying controller 123 to spray the ink i sequentially from each nozzle 52*a* in the ink-spraying timing which is before the paper carrying speed is changed.

Note that the temperature will have an influence on the recording paper P, which of course depends upon the type of the paper P as will be described below. Generally, when the temperature is high, the paper P and belt pulleys of the paper feed/delivery mechanism 72 will largely be elongated so that the change of the carrying speed in the process of printing is small, resulting in small color mis-registration. On the contrary, when the temperature is low, the paper P and belt pulleys will be little elongated, so that the carrying speed is largely changed in the process of printing, resulting in large color mis-registration.

More specifically, when the temperature and humidity are high, the endless drive belts connecting the aforementioned feed and delivery rollers 94 and 101 to the pulse motors 103*a* and 103*b*, respectively, are elongated, resulting in a larger pitch of the endless drive belts. Thus, the tension of the endless drive belts is lower and the feed pitch per tooth of the pulleys of the feed and delivery rollers 94 and 101, on which the endless drive belts are wound, respectively, is reduced, and the carrying speed of the paper P is decreased, resulting in color mis-registration which is smaller. That is, the displacement of the position to which the ink i in one color is projected from the position to which the ink i in other color is projected when the temperature and humidity are high is smaller than the color mis-registration caused by the change in carrying speed at normal temperature.

On the other hand, when the temperature and humidity are low, the endless drive belt will accordingly be reduced in length and thus have the pitch thereof decreased. Thus, the tension of the endless drive belt is increased, the feed pitch per tooth of the pulleys of the feed roller 94 and delivery roller 101 is increased, and the recording paper P is carried at a higher speed, resulting in a larger color mis-registration. That is, when the temperature and humidity are low, the displacement of the projected positions, from each other, of different colored ink i will be larger than the color mis-registration caused due to a change in carrying speed at normal temperature.

Therefore, when controlling the ink-spraying controller 123 according to the ink-spraying control data, the controller 129 is also supplied with the environment data from the temperature sensor 74 and has the ink-spraying controller 123 control the ink-spraying head 45 according to the environment data and ink-spraying control data.

The memory 128 is for example a ROM, EP-ROM, RAM or the like and has stored therein the aforementioned speed control data, carrying speed data for each type of the recording paper P, etc. Also, the memory 128 has stored therein, in addition to the above data, the ink-spraying control data generated by the controller 129 for each type of the paper P according to the ink-projected position data for the type of the paper P, detected by the ink-projected position detector 75.

In the control circuit 131 constructed as above, since the nipping or gripping of the feed and delivery rollers 94 and 101 varies depending upon the type, thickness and the like of the recording paper P and the carrying speed is changed to different extents, that is, the color mis-registration varies from one type of the paper P to another, the controller 129 generates ink-praying control data for each type of the paper P under printing and stores the data into the memory 128. It should be noted that in the control circuit 131, ink-spraying control data for common types of the paper P is pre-stored in the memory 128 in addition to the ink-spraying control data generated by the controller 129 and the ink-spraying controller 123 is controlled based on the pre-stored ink-spraying control data. Thus, when printing is made on recording paper P of a common type, a quality print can be assured with no color mis-registration with the ink-projected position detector 75 having not to read any test pattern 5 for generation of ink-spraying control data.

Although the control circuit 131 is designed as above so that a processing program is stored in the ROM 126, the medium to store the processing program is not limited to the ROM 126 but it may be for example an optical disk, magnetic disk, magneto-optical disk, IC card or the like having the processing program stored therein. In this case, the control circuit 131 is designed to be connected directly or by the information processor 130 to a drive that drives such a recording medium in order to read the processing program from the recording medium.

In the control circuit 131, the memory 128 is also designed to have speed discrimination data, carrying speed data, ink-spraying control data, etc. In case the RAM 127 and ROM 126 have sufficient capacity for storage of such data, the data may be stored in these memories.

Figure 25:
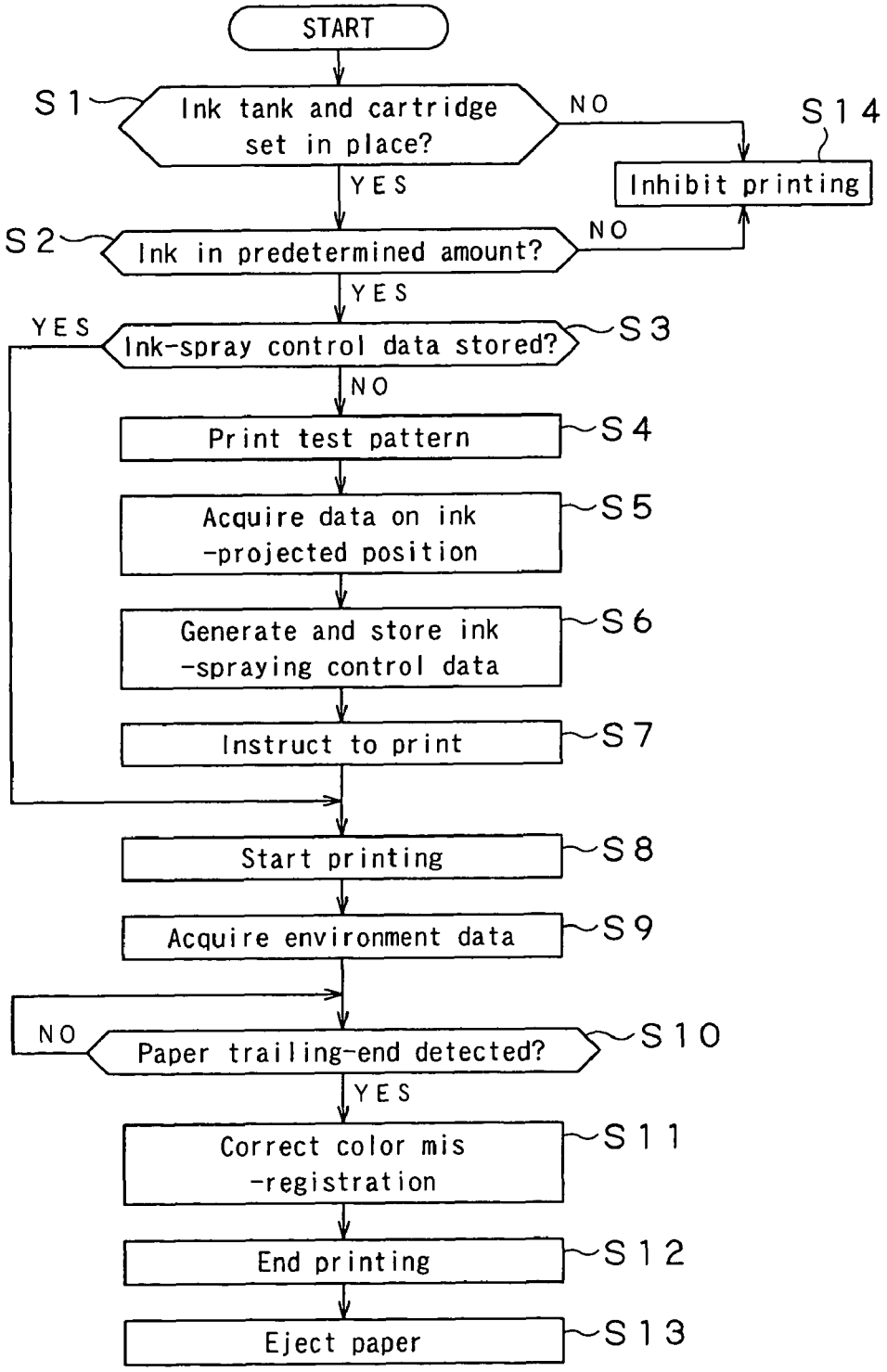
FIG. 25 shows a flow of operations made in printing preparation in the printer.

The printing operation of the printer 1 constructed as above will be explained below with reference to the flow diagram in FIG. 25. It should be noted that the printing will be done under the control of the CPU (not shown) in the controller 129 according to the processing program stored in the storage means such as the ROM 126 or the like.

For printing by the printer 1, the user first operates the control buttons 68 provided on the printer body 3 or enters a print command, which is to be followed by the printer 1, from the external information processor 130 to the controller 129 via the input/output terminal 125. At this time, information signal as to a type of recording P going to be used is also supplied to the controller 129 for setting the type of paper P for printing.

Supplied with the above print command, the controller 129 judges in step S1 whether ink tanks 11 for predetermined colors are set in place in the tank receptacle 31 and whether the head cartridge 2 is set in place in the head receptacle 66 of the printer body 3. When the controller 129 has determined that the ink tanks 11 for the predetermined colors are correctly set in all the tank receptacles 31 and the head cartridge 2 is set in the head receptacle 66 of the printer body 3, it goes to step S2. On the contrary, if the controller 129 has determined that the ink tanks 11 are not correctly set in the tank receptacle 31 and/or the head cartridge 2 is not correctly set in the head receptacle 66 of the printer body 3, it goes to step S14 where it will inhibit any more printing operation.

In step S2, the controller 129 judges whether the ink tank 11 contains the ink i in a smaller amount than predetermined or no ink i. When the controller 129 has determined that the ink tank 11 contains no ink i, it controls the alarm unit 124 to issue an alarm, and goes to step S14 where it will inhibit any more printing operation.

On the contrary, when the controller 129 has determined in step S2 that the ink tank 11 contains a larger amount of the ink i than predetermined, namely, that the ink tank 11 is filled with a sufficient amount of the ink i, it will go to step S3 where it will allow the printing operation.

Next in step S3, the controller 129 judges whether ink-spraying control data for recording paper P of a type commonly used for printing is stored in the memory 128. When the controller 129 has determined that the ink-spraying control data for the paper P going to be used is stored in the memory 128, it goes to step S8 where it will allow the printer 1 to start forming characters, graphics or the like by printing. On the contrary, if the controller 129 has determined that no ink-spraying control data for the paper P is stored in the memory 128, it goes to step S4 where it will allow the printer 1 to print a test pattern and generate ink-spraying control data for the paper P having the test pattern printed thereon.

Next in step S4, the controller 129 controls the printer drive 122 to drive the head cap operating mechanism 71 and paper feed/delivery mechanism 72, and the printer 1 to print a test pattern for generation of ink-spraying control data on the recording paper P having been carried to a position where printing is possible. More specifically, when an operation for printing the test pattern is started, the controller 129 controls the head cap operating mechanism 71 to move the head cap 44 having the spray surface 41 closed to the parking position at the front of the printer 1 as shown in FIG. 19. Also, the controller 129 controls the lifting mechanism (not shown) to move up the feed roller 94, delivery roller 101 and platen pallet 104 from the parking position to the carrying-ready position, and drives the pulse motors 103*a* and 103*b* to carry the paper P in the direction of arrow E in FIG. 17, as shown in FIG. 19. Then, the controller 129 controls the ink-spraying controller 123 to print a test pattern on the paper P having been carried to a position opposite to the ink-spraying surface 41.

Next in step S5, the controller 129 controls the ink-projected position detector 75 to read the test pattern on the recording paper P delivered by the delivery roller 101 from the printing position, detect a position to which each ink i is projected and supply the detected ink-projected positions as ink-projected position data to the controller 129.

Next in step S6, the controller 129 generates, based on the ink-projected position data supplied from the ink-projected position detector 75, ink-spraying control data intended for use to correct color mis-registration which will take place when the carrying speed is increased in the process of printing, and stores the data into the memory 128. The ink-spraying control data stored in the memory 128 is stored into the memory 128 as new ink-spraying control data for the type of the recording paper P, supplied when a print command is given, and is used for printing on the paper P of the same type. Then the controller 129 controls the alarm unit 124 to issue an alarm that there has been acquired ink-spraying control data for the paper P going to be used for printing.

Next in step S7, the controller 129 is supplied with a command for starting printing of characters and graphics when the user operates the control button 68 provided on the printer body 3 or when a command is supplied from the external information processor 130 via the input/output terminal 125.

Next in step S8, the controller 129 controls the printer drive 122 to drive the head cap operating mechanism 71 and paper feed/delivery mechanism 72, which will thus carry the recording paper P to a position where printing is possible, and the ink-spraying controller 123 to start printing characters and graphics onto the paper P having been carried to that printing position. At this time, in step S9, the controller 129 controls the temperature sensor 74 to detect the temperature near the head 37 and output it as environment data. Thus, the controller 129 acquires the environment data. More specifically, the controller 129 controls, based on the environment data supplied from the temperature sensor 74 and carrying-speed data for the type of the paper P, pre-stored in the memory 128, and set at the start of printing, the ink-spraying controller 123 to have the ink-spraying head 45 spray and project the ink i onto the paper P having been carried by the paper feed/delivery mechanism 72 to the printing position and kept tight by the feed and delivery rollers 94 and 101, to thereby form, on the paper P, characters and graphics from ink dots on the basis of data to be printed such as character data and graphic data supplied from the external information processor 130 or the like via the input/output terminal 125. It should be noted that in case no carrying speed data for the type of the paper P having a test pattern printed thereon are stored in the memory 128, the controller 129 generates carrying speed data according to data supplied from the paper trailing-end sensor 111, encoder 112 or the like at the time of printing the test pattern.

Next in step S10, the controller 129 controls the paper trailing-end sensor 111 of the speed discrimination unit 73 to continuously detect the trailing end of the recording paper P being printed. When the paper trailing-end sensor 111 detects the trailing end, the speed discrimination unit 73 will supply it as paper trailing-end detection data to the controller 129. The controller 129 controls the printer 1 to continuously make the printing operation as in step S8 until the trailing end of the paper P is detected. When the paper trailing-end sensor 111 detects the trailing end of the paper P, the controller 129 judges, based on the trailing-end detection data from the paper trailing-end sensor 111, rotation detection data from the encoder 112 and speed discrimination data pre-stored in the memory 128, whether the carrying speed of the paper P has been increased, and goes to step S11 where it will correct color mis-registration.

More specifically, when the speed discrimination unit detects the trailing end of the recording paper P and the controller 129 has determined that the carrying speed has been increased, the controller 129 having arrived at step S11 will control the ink-spraying head 45 by means of the ink spray controller 123 on the basis of the environment data from the temperature sensor and ink-spraying control data for the type of the paper P stored in the memory 128 to spray the other ink i than the black ink i in timing delayed in relation to that which is before the carrying speed is increased in order to correct the ink i-projected position for no color mis-registration.

After completion of the color misregistration correction in step S12, the controller 129 controls the ink-spraying controller 123 according to the ink-spraying control data to spray the ink i in each color sequentially again in the ink-spraying timing which is before the carrying speed is changed, and print the data to be printed to the last character or graphic and then terminates the printing.

Next in step S13, the controller 129 controls the paper feed/delivery mechanism 72 to deliver the printed recording paper P onto the lid tray 65 from the delivery roller 101, and exits the printing operation.

Then, in the printer 1, the printing operations in steps S1 to S14 are repeatedly done until the ink i in the ink tank 11 runs short, no more recording papers P remain in the paper tray 64 or a command for sopping the printing is supplied from the control buttons 68 or from the external information processor 130 via the input/output terminal 125.

In the printer 1 making the aforementioned printing operation, the paper trailing-end sensor 111 of the speed discrimination unit 73 detects the trailing end of the recording paper P being printed. When the speed discrimination unit 73 has determined that the carrying speed of the paper P has been increased, color mis-registration caused by the change of the carrying speed is corrected according to the environment data from the temperature sensor 74, ink-spraying control data generated by the controller 129 according to the ink-projected position data from the paper trailing-end detector 75 or the ink-spraying control data pre-stored in the memory 128.

That is, in the printer 1, when the carrying speed of the recording paper P is increased in the process of printing, the timing of spraying the other ink i than the black ink i which is sprayed from the nozzle 52*a* provided most downstream in the carrying direction is delayed in relation to that which is before the carrying speed of the paper P is increased according to the ink-spraying control data including the environment data to project the other ink i than the black ink i to the position to which the black ink i is projected in order to correct the color mis-registration caused by the change of the paper carrying speed.

Therefore, in the printer 1, even if the carrying speed is changed in the process of printing, ink is sprayed and projected with the type of the recording paper P, ambient temperature, etc. taken in consideration and thus it is possible to make quality printing free from any color mis-registration caused by the change of the carrying speed in the process of printing.

Although the present invention has been illustrated and described taking the application thereof to the printer by way of example, it is not limited to this embodiment but it may widely be applied to any other liquid spraying apparatuses. The present invention is applicable to a facsimile, copier, DNA chip spraying apparatus which sprays a mixture of a liquid and DNA chip (as in the Japanese Patent Application Laid Open No. 2002-34560), a liquid spraying apparatus which sprays a liquid containing conductive particles for forming a wiring pattern on a printed wiring board, etc. for example.

Also, there has been illustrated and explained the ink-spraying head 45 in which the ink i is heated by one resistance heater 55 for spraying, by way of example in the foregoing. However, the present invention is not limited to such an ink-spraying head, but it is applicable to a liquid spraying apparatus including a plurality of pressure-producing elements and an ink-spraying means capable of controlling the ink-spraying direction by supplying different energies to, or an energy at different times, to the pressure-producing elements, respectively.

Further, the aforementioned embodiments use the electromechanical transducing system in which droplets of the ink i being heated by one resistance heater 55 are sprayed from the nozzles 52*a*. However, the present invention is not limited to this system but may adopt an electromechanical transducing system in which droplets of the ink are sprayed electromechanically by an electromechanical transducing element such as piezzoelectric element, for example.

Moreover, the present invention has been illustrated and explained concerning the line printer 1 by way of example. However, the present invention is not limited to such a line printer but may be applied to a serial type liquid spraying apparatus in which the ink head is moved in a direction generally perpendicular to the moving direction of the recording paper P, for example.

In the foregoing, the present invention has been described in detail concerning certain preferred embodiments thereof as examples with reference to the accompanying drawings. However, it should be understood by those ordinarily skilled in the art that the present invention is not limited to the embodiments but can be modified in various manners, constructed alternatively or embodied in various other forms without departing from the scope and spirit thereof as set forth and defined in the appended claims.

The invention claimed is:

1. A printing apparatus comprising:

a carrying means for carrying an object onto which liquid is to be projected;

a liquid spraying means having nozzles to spray the liquid as droplets onto the object having been carried to a position where the object faces the nozzles;

a liquid-spraying controlling means for controlling the liquid spraying means to spray the droplets from the nozzles at a predetermined timing;

an environment detecting means for detecting an ambient temperature and/or humidity when the droplets are sprayed from the nozzles;

a carrying-speed discriminating means for judging whether the carrying speed of the object has been changed; and a storage means having stored therein liquid-spraying control data intended for controlling the liquid-spraying timing the liquid-spraying controlling means controlling the liquid-spraying means when the carrying-speed discriminating means has determined that the object carrying speed has been changed to alter currently used liquid-spraying control data on the basis of the environment data detected by the environment detecting means to spray the droplets from the nozzles at a different timing from that which is before the carrying speed is changed and further wherein the liquid-spraying control data is adjusted based on carrying-speed change information and environment data in order to reduce color mis-registration in printed image data so that a timing of ink ejection for each of a plurality of different color ink emitters is altered for each of the different ink emitters.

2. The printing apparatus according to claim 1, wherein:

the liquid spraying means has a plurality of the nozzles disposed side by side in the object-carrying direction to spray the droplets toward the object first from the upstream nozzle in the object-carrying direction and finally from the downstream one in this order in the object-carrying direction.

3. The printing apparatus according to claim 1, wherein the carrying means includes a feed roller that rotates about its own axis and a delivery roller located downstream in the object carrying direction in relation to the liquid spraying means which rotates about its own axis at a higher speed than the feed roller.

4. The printing apparatus according to claim 1, wherein the carrying-speed discriminating means includes a trailing-end sensor located upstream of the liquid-spraying means in the object-carrying direction to detect the trailing end of the object in the carrying direction and which determines that the carrying speed has been changed.

5. The printing apparatus according to claim 1, wherein the nozzles of the liquid-spraying means are disposed side by side generally in line in a direction generally perpendicular to the object-carrying direction.

6. A printing method comprising:

carrying an object onto which liquid is to be projected in a predetermined direction via a carrying mechanism;

spraying liquid as droplets onto the object by a liquid spraying mechanism having nozzles;

controlling the liquid spraying means to spray the droplets from the nozzles in predetermined timing with a liquid spraying controlling mechanism;

detecting an ambient temperature and/or humidity when the droplets are sprayed from the nozzles with an environment detecting mechanism;

judging whether the carrying speed of the object has been changed with a carrying speed detecting mechanism; and storing liquid-spraying control data intended for controlling the liquid-spraying timing, spraying droplets from the nozzles at a different timing when the carrying speed detecting mechanism determines that the carrying speed has changed based on the environment data detected by the environment detecting mechanism and further wherein the liquid-spraying control data is adjusted based on carrying-speed change information and environment data in order to reduce color mis-registration in printed image data so that a timing of ink ejection for each of a plurality of different color ink emitters is altered for each of the different ink emitters.

7. The printing apparatus according to claim 1, wherein the ink ejecting timing is altered depending upon a type of paper used by the printing apparatus.

8. The printing method according to claim 6, wherein:

a plurality of the nozzles are disposed side by side in the object-carrying direction to spray the droplets toward the object first from an upstream nozzle in the object-carrying direction and finally from a downstream one in this order in the object-carrying direction.

9. The printing method according to claim 8, wherein the carrying mechanism includes a feed roller located upstream of the liquid-spraying means in the object carrying direction that rotates about its own axis, and a delivery roller located downstream of the liquid-spraying means in the object carrying direction that rotates about its own axis at a higher speed than the feed roller.

10. The printing method according to claim 6, wherein the carrying speed detecting mechanism includes a trailing-end sensor located upstream of the liquid-spraying means in the object-carrying direction which detects the trailing end of the object in the carrying direction and which determines that the carrying speed has been changed.

11. The printing method according to claim 6, wherein the nozzles are disposed side by side generally in line in a direction generally perpendicular to the object-carrying direction.

12. The printing method according to claim 6, wherein the ink ejecting timing is altered depending upon a type of paper.

13. A printing device comprising;

a carrying means for carrying an object onto which liquid is to be projected in a predetermined direction;

a liquid spraying means having nozzles to spray the liquid as droplets onto the object having been carried to a position where the object faces the nozzles;

a liquid-spraying controlling means for controlling the liquid spraying means to spray the droplets from the nozzles at a predetermined timing;

an environment detecting means for detecting an ambient temperature and/or humidity when the droplets are sprayed from the nozzles;

a carrying-speed discriminating means for judging whether the carrying speed of the object has been changed;

a droplet-projected position detecting means for detecting a displacement of a droplet-projected position which arises when the droplets are projected in a predetermined pattern on the object being carried because the object carrying speed has been changed;

a data generating means for generating liquid-spraying control data intended for controlling the liquid-spraying timing to correct the displacement of droplet-projected position detected by the liquid-protected position detecting means; and a storage means for storing the liquid-spraying control data generated by the data generating means, the liquid-spraying controlling means controlling the liquid-spraying means when the carrying-speed discriminating means has determined that the object carrying speed has been changed on the basis of the environment data detected by the environment detecting means and liquid-spraying control data, stored in the storage means, to spray the droplets from the nozzles at a different timing from that which is before the carrying speed is changed and further wherein the liquid-spraying control data is adjusted based on carrying-speed change information and environment data in order to reduce color mis-registration in printed image data so that a timing of ink ejection for each of a plurality of different color ink emitters is altered for each of the different ink emitters.

14. The printing apparatus according to claim 13, wherein the liquid spraying means has a plurality of the nozzles disposed side by side in the object-carrying direction to spray the droplets toward the object first from the upstream nozzle in the object-carrying direction and finally from the downstream one in this order in the object-carrying direction.

15. The printing apparatus according to claim 13, wherein:

the carrying means includes a feed roller that rotates about its own axis and a delivery roller located downstream in the object carrying direction in relation to the liquid spraying means which rotates about its own axis at a higher speed than the feed roller.

16. The printing apparatus according to claim 13, wherein the carrying-speed discriminating means includes a trailing-end sensor provided upstream in the object-carrying direction in relation to the liquid-spraying means to detect the trailing end of the object in the carrying direction and which determines that the carrying speed has been changed.

17. The printing apparatus according to claim 13, wherein the storage means has pre-stored therein the liquid-spraying control data.

18. The printing apparatus according to claim 13, wherein the nozzles of the liquid-spraying means are disposed side by side generally in line in a direction generally perpendicular to the object-carrying direction.

19. A printing method for comprising:

carrying an object onto which liquid is to be projected in a predetermined direction with a carrying mechanism;

spraying the liquid as droplets onto the object having been carried to a position where the object faces the nozzles with a liquid spraying mechanism;

controlling the liquid spraying mechanism to spray the droplets from the nozzles at a predetermined timing;

detecting an ambient temperature and/or humidity when the droplets are sprayed from the nozzles with an environment detecting apparatus;

judging whether the carrying speed of the object has been changed with a carrying speed discriminating mechanism;

detecting a displacement of droplet-projected position which arises when the object carrying speed has been changed with a droplet projected position detecting mechanism;

generating liquid-spraying control data intended for controlling the liquid-spraying timing to correct the displacement of droplet-projected position detected by the liquid-protected position detecting mechanism; and storing the liquid-spraying control data whereby when the carrying-speed discriminating mechanism has determined that the object carrying speed has been changed, the liquid-spraying controlling mechanism controls the liquid-spraying mechanism on the basis of the environment data detected by the environment detecting mechanism and liquid-spraying control data to spray the droplets from the nozzles at a different timing from that which is before the carrying speed is changed and further wherein the liquid-spraying control data is adjusted based on carrying-speed change information and environment data in order to reduce color mis-registration in printed image data so that a timing of ink ejection for each of a plurality of different color ink emitters is altered for each of the different ink emitters.

20. The printing method according to claim 19, wherein:

a plurality of the nozzles are disposed side by side in the object-carrying direction to spray the droplets toward the object first from the upstream nozzle in the object-carrying direction and finally from the downstream one in this order in the object-carrying direction.

21. The printing method according to claim 19, wherein as the carrying mechanism, there are provided a feed roller located upstream of the liquid-spraying means in the object carrying direction, and a delivery roller located downstream of the liquid-spraying means in the object carrying direction which rotates about its own axis at a higher speed than the feed roller.

22. The printing method according to claim 19, wherein the carrying-speed discriminating mechanism includes a trailing-end sensor located upstream of the liquid-spraying means in the object-carrying direction to detect the trailing end of the object in the carrying direction and which determines that the carrying speed has been changed.

23. The printing method according to claim 19, wherein the liquid-spraying control data is pre-stored.

24. The printing method according to claim 17, wherein the nozzles are disposed side by side generally in line in a direction generally perpendicular to the object-carrying direction.

* * * * *